US012239877B2

(12) United States Patent
Zanyk

(10) Patent No.: US 12,239,877 B2
(45) Date of Patent: Mar. 4, 2025

(54) EXERCISE APPARATUS

(71) Applicant: W2DESIGNS LLC, South Glastonbury, CT (US)

(72) Inventor: Marien J. Zanyk, South Glastonbury, CT (US)

(73) Assignee: W2DESIGNS LLC, South Glastonbury, CT (US)

( * ) Notice: Subject to any disclaimer, the term of this patent is extended or adjusted under 35 U.S.C. 154(b) by 157 days.

(21) Appl. No.: 18/191,584

(22) Filed: Mar. 28, 2023

(65) Prior Publication Data

US 2023/0285798 A1 Sep. 14, 2023

Related U.S. Application Data

(63) Continuation-in-part of application No. 16/640,674, filed as application No. PCT/US2018/047601 on Aug. 22, 2018, now Pat. No. 11,612,782.
(Continued)

(51) Int. Cl.
*A63B 21/00* (2006.01)

(52) U.S. Cl.
CPC ..... *A63B 21/4037* (2015.10); *A63B 2210/50* (2013.01)

(58) Field of Classification Search
CPC ..... A63B 6/00; A63B 17/00; A63B 17/04; A63B 21/00047; A63B 21/0005; A63B 21/00054; A63B 21/00185; A63B 21/002; A63B 21/0023; A63B 21/04; A63B 21/0407; A63B 21/0414; A63B 21/0421; A63B 21/0428; A63B 21/0435; A63B 21/0442; A63B 21/05; A63B 21/055; A63B 21/0552; A63B 21/0555; A63B 21/0557; A63B 21/068; A63B 21/4023;
(Continued)

(56) References Cited

U.S. PATENT DOCUMENTS 3,284,819 A 11/1966 Nissen
3,319,273 A 5/1967 Lawrence
(Continued)

OTHER PUBLICATIONS

BedROK DEMO Video—WILLOW WorkoutTM Freeform Exercise Jul. 9, 2017 online retrieved from URL: https://www.youtube.com/watch?+CFIgEYr1Kls> entire document, especially 0:07-0:22.
(Continued)

*Primary Examiner* — Gary D Urbiel Goldner
(74) *Attorney, Agent, or Firm* — Wm. Tucker Griffith; Lathrop GMP LLP

(57) ABSTRACT

The present disclosure provides an exercise apparatus with a mobility mat and an orthopedic device. The mobility mat can have a plurality of segments or have a single piece construction. The mobility mat includes a body provided with a plurality of assistive features, such as hand holds, foot holds, resistance bands, various exercise grips, and a contoured cushion. These assistive features can be removably attached to the mobility mat using grommets formed in the mat body and holding tabs that can be secured in the grommets. The mobility mat can be further configured to couple with the orthopedic device. The orthopedic device can have an inclined face and a plurality of remaining faces including various additional assistive features.

18 Claims, 16 Drawing Sheets

Related U.S. Application Data

(60) Provisional application No. 62/554,671, filed on Sep. 6, 2017, provisional application No. 62/548,523, filed on Aug. 22, 2017.

(58) Field of Classification Search
CPC ..... A63B 21/4027; A63B 21/4033; A63B 21/4034; A63B 21/4035; A63B 21/4037; A63B 21/4039; A63B 23/12; A63B 23/1209; A63B 23/1236; A63B 26/00; A63B 26/003; A63B 71/0036; A63B 2208/02; A63B 2208/0204; A63B 2208/0209; A63B 2208/0214; A63B 2208/0219; A63B 2208/0223; A63B 2208/0228; A63B 2208/0238; A63B 2208/0242; A63B 2208/0247; A63B 2208/0252; A63B 2208/0257; A63B 2208/0261; A63B 2208/0266; A63B 2208/0271; A63B 2208/028; A63B 2208/0295; A63B 2209/00; A63B 2209/08; A63B 2209/10; A63B 2210/00; A63B 2210/50; A63B 2210/52; A63B 2210/54; A63B 2225/09; A63B 2225/093
See application file for complete search history.

(56) References Cited

U.S. PATENT DOCUMENTS

| | | | | |
|---|---|---|---|---|
| 4,210,322 | A | 7/1980 | Pritchard | |
| 4,575,369 | A | 3/1986 | Grayek | |
| 4,905,990 | A | 3/1990 | DeSantis | |
| 4,987,625 | A | 1/1991 | Edelson | |
| 5,066,001 | A | 11/1991 | Wilkinson | |
| 5,100,130 | A | 3/1992 | Shoebrooks | |
| 5,370,460 | A | 12/1994 | Nelson | |
| 5,417,636 | A | 5/1995 | Havens | |
| 5,551,934 | A | 9/1996 | Binette | |
| 5,584,786 | A | 12/1996 | Almeda | |
| 5,722,923 | A | 3/1998 | Lui | |
| 5,941,638 | A | 8/1999 | Fonseca | |
| 6,322,485 | B1 | 11/2001 | Marrero | |
| 6,623,270 | B1 | 9/2003 | Meldeau | |
| 6,648,838 | B1 | 11/2003 | Brandon | |
| 6,751,816 | B1 | 6/2004 | Wechsler | |
| 7,207,932 | B1 | 4/2007 | Dean | |
| 7,452,313 | B2 | 11/2008 | Endelman | |
| 7,520,846 | B1 | 4/2009 | Manuel | |
| 8,037,561 | B2 | 10/2011 | Austwick | |
| 8,075,464 | B2 | 12/2011 | Hayes | |
| 8,296,881 | B2 | 10/2012 | Litman | |
| RE43,981 | E | 2/2013 | Endelman | |
| 8,631,833 | B2 | 1/2014 | Garbarino | |
| 8,632,443 | B2 | 1/2014 | Hauptmann | |
| 9,295,337 | B1 | 3/2016 | Bavli | |
| 9,545,537 | B2 | 1/2017 | Savioli | |
| 9,964,254 | B1 | 5/2018 | Hayes | |
| 10,342,321 | B1 | 7/2019 | Le | |
| 11,612,782 | B2 * | 3/2023 | Zanyk | A63B 21/4034 482/142 |
| 2005/0192158 | A1 | 9/2005 | Edwards | |
| 2007/0275827 | A1 | 11/2007 | Glaser | |
| 2008/0058165 | A1 | 3/2008 | Schletti | |
| 2008/0118671 | A1 | 5/2008 | Bienkiewicz | |
| 2009/0260157 | A1 | 10/2009 | Gere | |
| 2010/0016134 | A1 | 1/2010 | Reese | |
| 2010/0115698 | A1 | 5/2010 | Litman | |
| 2010/0143645 | A1 | 6/2010 | Wilmsen | |
| 2010/0197471 | A1 | 8/2010 | Hayes | |
| 2010/0267532 | A1 | 10/2010 | Newburger | |
| 2012/0233772 | A1 | 9/2012 | Wang | |
| 2013/0180046 | A1 | 7/2013 | Davis | |
| 2013/0276230 | A1 * | 10/2013 | Kress | A63B 21/4037 5/419 |
| 2013/0324382 | A1 | 12/2013 | Wilson | |
| 2014/0101848 | A1 | 4/2014 | Murphy | |
| 2014/0242357 | A1 | 8/2014 | Morris | |
| 2014/0342118 | A1 | 11/2014 | Connaughton | |
| 2015/0143631 | A1 | 5/2015 | Fleming | |
| 2016/0059066 | A1 * | 3/2016 | Willis | A63B 21/4037 5/417 |
| 2016/0129299 | A1 | 5/2016 | Newman | |
| 2017/0266485 | A1 * | 9/2017 | Willis | A63B 21/4037 |
| 2017/0291055 | A1 | 10/2017 | Madion | |
| 2018/0028853 | A1 | 2/2018 | Cargill | |
| 2018/0243166 | A1 | 8/2018 | Splichal | |
| 2018/0250549 | A1 * | 9/2018 | Paton | D03D 3/08 |
| 2020/0179211 | A1 * | 6/2020 | Zanyk | A61H 1/0266 |
| 2020/0215379 | A1 * | 7/2020 | Stryska | A63B 21/4037 |
| 2020/0353307 | A1 * | 11/2020 | Zanyk | A63B 21/4037 |
| 2021/0346751 | A1 * | 11/2021 | Paton | D03D 15/58 |
| 2022/0040519 | A1 * | 2/2022 | Do | A63B 3/00 |

OTHER PUBLICATIONS

PCT Application No. PCT/US2018/047601, International Search Report dated Nov. 21, 2018, 9 pages.

* cited by examiner

EXERCISE APPARATUS

CROSS-REFERENCE TO RELATED APPLICATIONS

The present application claims the benefit of and priority to U.S. application Ser. No. 16/640,674, filed Aug. 22, 2018, and issued as U.S. Pat. No. 11,612,782 on Mar. 28, 2023, which is a 371 application of PCT Application No. PCT/US2018/047601, filed on Aug. 22, 2018, which claims priority to U.S. Provisional Application No. 62/548,523, filed Aug. 22, 2017, and U.S. Provisional Application No. 62/554,671, filed Sep. 6, 2017, each of which is hereby incorporated by reference herein in its entirety.

FIELD OF INVENTION

The present invention relates to exercise apparatus, and, more specifically, to exercise apparatus comprising a mobility mat and attachable orthopedic device.

BACKGROUND OF THE INVENTION

The fitness industry has grown significantly as society increasingly recognizes the relationship between health and fitness. In order to stay healthy, people need a pain free way to exercise. Freestyle fitness equipment has grown in popularity as consumers desire exercise equipment that can be easily transported, used in locations other than a gym, and used without an instructor. However, existing exercise apparatus can be outdated, expensive, and with limited or ineffective applications.

For example, existing yoga mats provide a basic structure upon which to perform free-standing exercises. However, existing yoga mats generally lack any assistive features that can help a user perform progressive chains of movement to match natural positions, The lack of additional features of existing yoga mats limits a user's exercise routine to unassisted movement. A user is more likely to be injured during unassisted movements due to instability and improper joint and muscle load as the user struggles to maintain proper balance. A user's knees and ankles are particularly at risk.

Furthermore, a user can risk additional injury if the user attempts to supplement the unassisted movements with heavy metal weights. Heavy metal weights do not allow variety of force for the appropriate joint and soft tissue group. This risks additional injury because the user may not even be able to determine the appropriate force. Additionally, unassisted movements do not enable progressive, controlled positions for targeted tissue recovery through chains of movement.

Assistive features can help users explore a wider range of movements, achieve greater versatility in limb positions, rehabilitate injured joints and/or muscles, target specific body parts, combinations thereof, or the like.

Therefore, it would be desirable to have freestyle fitness equipment that can address the deficiencies described above and/or meet the fitness and rehabilitative needs of consumers.

SUMMARY OF THE INVENTION

The various examples of the present disclosure are directed towards exercise apparatus. A first embodiment of the present disclosure can provide for a mobility mat. The mobility mat can have a plurality of segments with a top surface and a bottom surface. The first surface can be a top surface of the mat and the second surface can be a bottom surface of the mat. The mobility mat can also have a plurality of segments. A first segment can include a cushion and at least one hand hold. A second segment can be positioned opposite the first segment and include at least one hand hold and at least one foot hold. The plurality of segments can also include at least one middle segment positioned between the first and second segment. The middle segment can include at least one hand hold.

A second embodiment of the present disclosure can provide for an orthopedic device. The orthopedic device can have a plurality of sides. A first side can have an inclined portion. A second side can have a two-tiered ledge. Opposing side portions can bridge the first side and the second side. Each of the opposing side portions can include a generally rounded hand grip and a generally flat hand grip. The orthopedic device can further include a contoured top side.

The mobility mat and the orthopedic device can be as explained previously. For example, the mobility mat can have a plurality of segments, a top surface, and a bottom surface, as described previously. In a third embodiment, the mobility mat can also have at least one first connector. The orthopedic device can include a plurality of sides with various features as described previously. In the third embodiment, the orthopedic device can also include at least one second connector. The at least one second connector can be configured to receive the at least one first connector of the mobility mat.

In another embodiment of the exercise apparatus, a mobility mat comprises a foam body including a top surface and a bottom surface and defining a first end portion and a second end portion with an intermediate portion disposed therebetween. The foam body, preferably a one-piece mat in this embodiment, is adapted to be folded about a central axis associated with the intermediate portion or rolled up. The exercise apparatus also includes a cushion coupled to the foam body of the mobility mat. The cushion is shaped in a hollowed semi-circular configuration to yield a base, a first extension generally extending from a first side of the base, and a second extension generally extending from a second side of the base. The foam body of the mobility mat further includes a plurality of grommets adapted for receiving at least one supplemental exercise tool. In preferred embodiments, the supplemental exercise tool, such as a hand hold, a foot hold, a resistance band, and a variety of grip devices, can be connected to the mobility mat using holding tbs secured in the grommets.

BRIEF DESCRIPTION OF THE DRAWINGS

The accompanying drawings exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements and are not drawn to scale.

DETAILED DESCRIPTION

Figure 1:
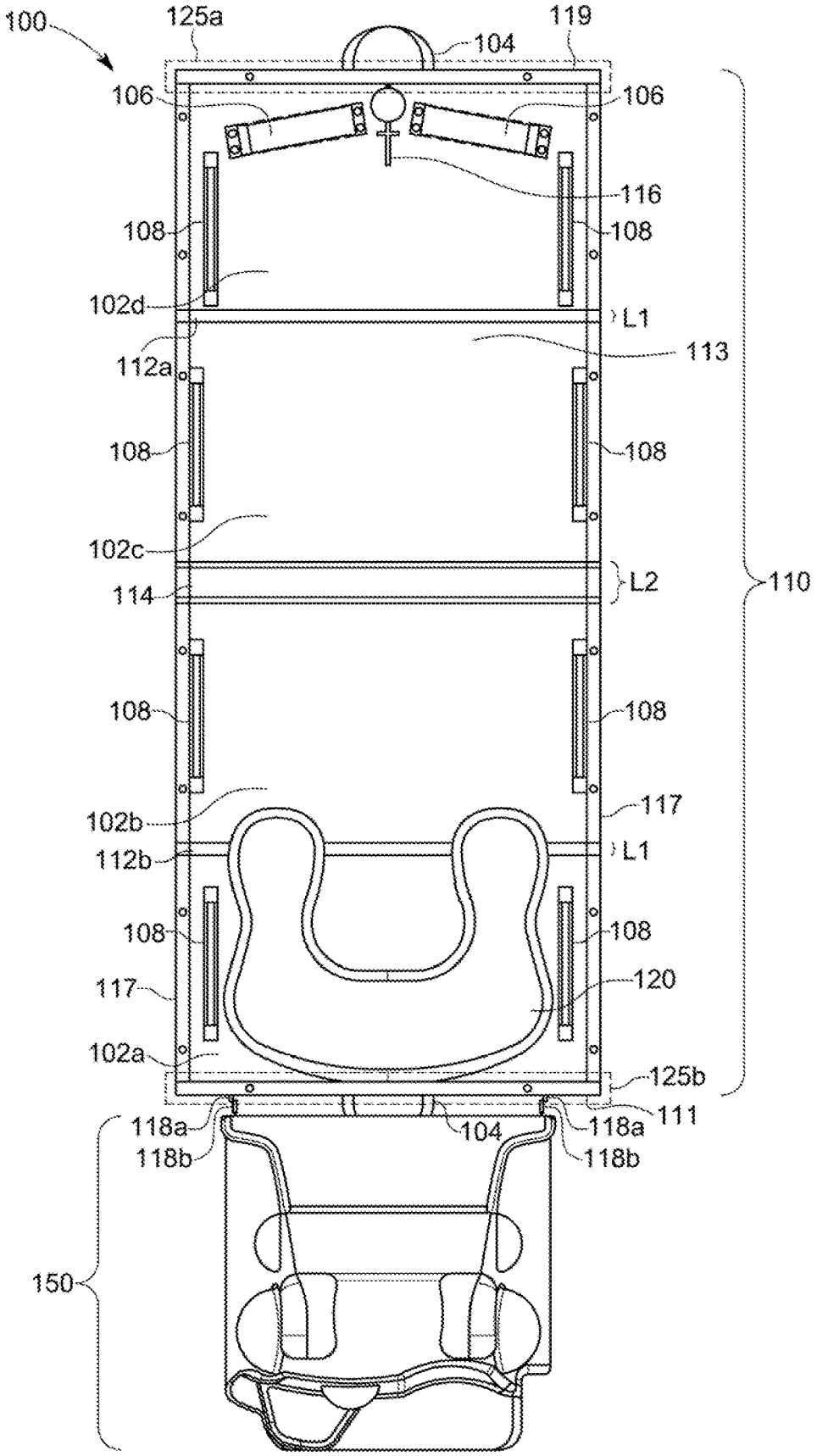
FIG. 1 shows a schematic diagram of a top surface of an exemplary exercise apparatus according to an embodiment of the present disclosure.

The present invention is described with reference to the attached figures, where like reference numerals are used throughout the figures to designate similar or equivalent elements. The figures are not drawn to scale and are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details, or with other methods. In other instances, well-known structures or operations are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The present disclosure is directed to an exercise apparatus that includes a mobility mat, which may optionally include an orthopedic device. The mobility mat can have a plurality of segments (as illustrated in the embodiment shown in FIG. 1) or have a one-piece construction (as illustrated in the embodiment shown in FIG. 10), and be provided with a plurality of assistive or supplemental exercise features such as hand holds, foot holds, resistance bands, a variety of exercise grip devices, and/or a contoured cushion. The mobility mat can be configured to couple with the orthopedic device. The orthopedic device can have an inclined face and a plurality of remaining faces including various additional assistive features, as will be described in more detail below. These assistive features allow a user internet therewith to target specific body parts, rehabilitate from injury, and/or achieve a wide variety in exercises with a single piece of integrated equipment. Non-limiting additional benefits of the various assistive features are discussed through the present disclosure with respect to each of the features.

FIG. 1 shows a schematic diagram of an exemplary exercise apparatus 100, according to an embodiment of the present disclosure. For example, apparatus 100 includes a mobility mat 110 and an optional orthopedic device 150 that may be coupled thereto. In one embodiment, the mobility mat 110 includes a plurality of segments 102*a*, 102*b*, 102*c*, and 102*d*, handles 104, foot holds 106, hand holds 108, connecting segments 112 and 114, receiving element 116, optional connectors 118, and a cushion 120. FIG. 1 shows how the mobility mat 110 can be coupled, with the orthopedic device 150 via the connectors 118 to provide an exercise apparatus with a variety of exercise features.

The connectors 118 include a first at least one connector 118*a* positioned at a first end 111 of the mobility mat 110 and a second at least one connector 118*b* positioned on a portion of the orthopedic device 150 configured to be adjacent to the first end of the mobility 110. The first and second connectors 118*a*, 118*b* are configured to mate with one another such that the orthopedic device 150 may be coupled to the mobility mat 110. It is contemplated that any suitable type of connecters 118 may be used including, for example, hooks, snaps, hook-and-loop type fasteners, Velcro, male and female connectors, adhesive elements, magnets, or any other material, any combination thereof or the like.

The orthopedic device 150 will be discussed further with respect to FIGS. 8A-8D. Example exercise techniques involving both orthopedic device 150 and mobility mat 110 will be discussed later with respect to FIGS. 9A-9D.

Figure 10:
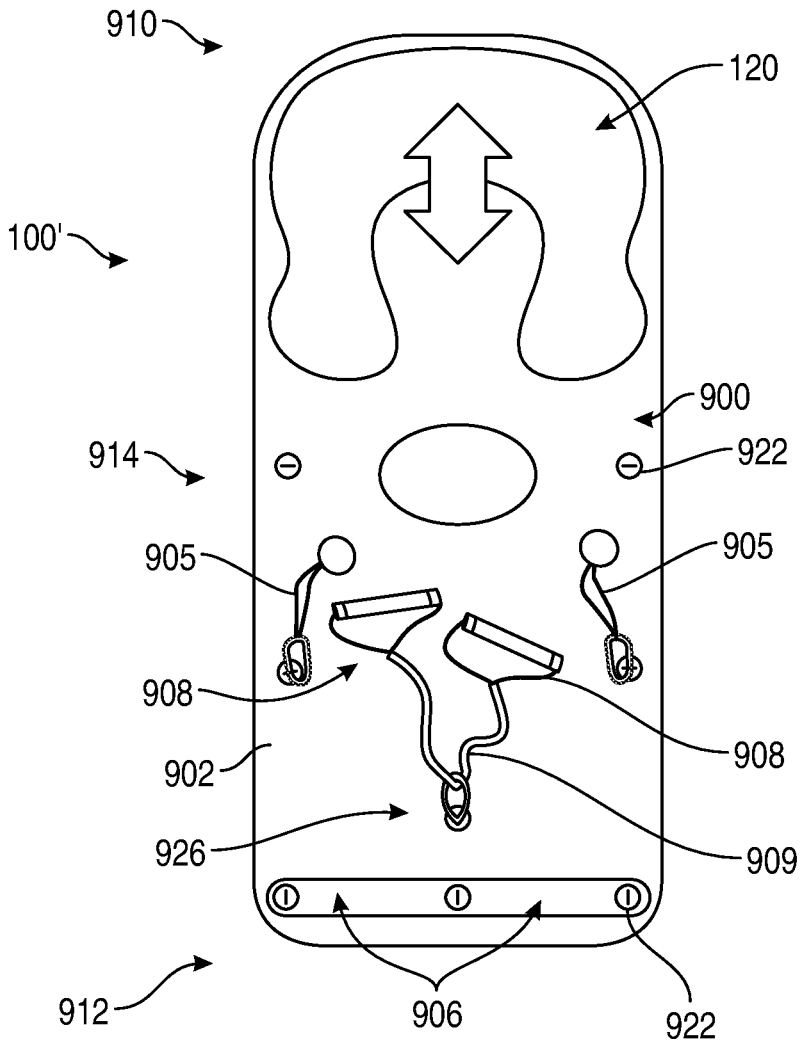
FIG. 10 shows a planar top view of an exemplary exercise apparatus according to an alternate embodiment of the present disclosure.

In the non-limiting embodiment of FIG. 1, the mobility mat 110 includes four segments: a top segment 102*a*, a second segment 102*b*, a third segment 102*c*, and a bottom segment 102*d*. Although four segments 102 are shown in FIG. 1, any suitable number of segments 102 can be included—e.g., a one-piece design, as illustrated in the embodiment of FIG. 10. The four segments 102*a*, 102*b*,

102*c*, and 102*d* shown in FIG. 1 are generally rectangular in shape and can provide a cumulative length approximately equal to the average height of a person. For example, the four segments 102*a*, 102*b*, 102*c*, and 102*d* can have a cumulative length of 74 inches. Each segment can have a width of 30.5 inches and a depth of approximately one inch. Although the four segments 102*a*, 102*b*, 102*c*, and 102*d* are shown in FIG. 1 to be approximately uniform in length, each segment can have a unique length. For example, the top and bottom segments 102*a*, 102*d* can have a length of 17.75 inches while second and third segments 102*b*, 102*c* have a length of 19.25 inches. In some embodiments, the widths of each segment are generally the same. In general, the rectangular shape and size of the plurality of segments 102*a*, 102*b*, 102*c*, and 102*d* can enable a variety of exercise positions along the length and width of the mat. The plurality of segments 102*a*, 1 02*b*, 102*c*, and 102*d* can provide cushioning to a user's head, torso, and limbs as the user moves through desired exercise positions.

In accordance with an embodiment of the present invention, the mobility mat 110 can be made of a plurality of layers or a single layer such that the body of the mat 110 provides cushioning between a user and the floor. In this regard, the body of the mobility mat, including segments thereof, when provided, can be a compliant and/or pliant foam material. Referring to the embodiment of FIG. 1, it is contemplated that each of the four segments 102*a*, 102*b*, 102*c*, 102*d* may be made of the same or different materials or combinations of materials. For example, segments 102*a*, 102*b*, 102*c*, and 102*d* can be constructed of foam, rubber, yoga mat material, Naugahyde, leather, vinyl, any other protective material, and any combinations thereof or similar materials.

The top and second segment 102*a*, 102*b* and the third and bottom segments 102*c*, 102*d* can be coupled to each other via connecting segments 112*a*, 112*b*. The second and third segments 102*b* and 102*c* can be coupled to each other via a generally central connecting segment 114. Connecting segments 112*a*, 112*b*, 114 can be comprised of a material that is generally thinner than the segments 102*a*, 102*b*, 102*c*, and 102*d*. Connecting segments 112*a*, 112*b*, and 114 can be generally flat, thin, and flexible. In some embodiments, the connecting segments 112*a*, 112*b* have a length L1 generally equal to a depth D1 (see FIG. 2B) of one of the segments 102*a*, 102*b*, 102*c*, or 102*d*. In some embodiments, the generally central connecting section 114 has a length L2 that is generally twice as long as the length L1 of the connecting segments 112*a*, 112*b*. Such measurements assist the mobility mat 110 to fold neatly so that the four segments 102*a*, 102*b*, 102*c*, and 102*d* lie generally flush against one another when the mobility mat 110 is in a folded position. This is discussed further with respect to FIGS. 7A-7C.

Referring back to FIG. 1, the mobility mats 110 can have one or more foot holds 106 and hand holds 108. Although the foot holds 106 and hand holds 108 are referred to herein to indicate the use of a particular limb, both sets of holds 106, 108 can be used by any limb of the user, i.e., the user may use the foot and hand holds 106, 108 interchangeably, depending, for example, on the type of exercise, position, or stretch that is being performed. For example, a user can grasp the foot hold 106 with his or her hand or anchor his or her foot between the hand hold 108 and the top surface 113 of the mobility mat 110.

As shown in FIG. 1, each segment 102*a*, 102*b*, 102*c*, and 102*d* can include at least one hand hold 108. In a particular configuration of the present disclosure, each segment 102*a*, 102*b*, 102*c*, and 102*d* includes two hand holds 108, wherein each hand hold is positioned on an opposing side of the respective segment at or near the edge of the mobility mat 110. Additionally, the bottom segment 102*d* as shown in FIG. 1 can include the one or more (e.g., two) foot holds 106. The opposing ends of the foot holds 106 and hand holds 108 are generally coupled to the top surface 113 of the mobility mat 110, thereby forming an aperture between the respective foot/hand hold 106, 108 and the top surface 113 of the mobility mat 110 such that a human hand or foot may be received by the aperture. The foot holds 106 and/or hand holds 108 thereby assist in anchoring the user to the mobility mat 110 such that the user can position his or her body in various exercise positions on the mobility mat 110. Additionally, the sets of consecutive hand holds 108 along the sides of-mobility mat 110 allow a user to move through various hand holds 108 to encourage progressive physical movement at different angles. This can be especially beneficial for therapeutic and orthotic recoveries. Particular shapes of hand holds 108 and foot holds 106 are discussed in more detail below with respect to FIGS. 4-5.

In the embodiment of FIG. 1, the hand holds 108 are positioned at varying distances from the edge 117 of the mobility mat 110. For example, the hand holds 108 on the top and bottom segments 102*a*, 102*d* are farther inset into an interior portion of the mobility mat 110 than the hand holds 108 on the second and third segments 102*b*, 102*c* of the mobility mat. For example, the hand holds 108 can vary from between 0.5-4 inches from the edge 117 of the mobility mat 110. Such a configuration allows the respective hand holds 108 to lie adjacent to each other, without overlapping, when the mobility mat 110 is in a folded position such that a compact, generally slim folded position may be obtained.

The mobility mat 110 can further include handles 104 positioned at generally opposite ends 111, 119 thereof. The handles 104 may be positioned along the opposing edges 111, near the opposing edges 111 on a back side of the mobility mat 110, or the like (discussed further with respect to FIG. 2A), The handles 104 can be used to easily move mobility mat 110 when mobility mat 110 is stretched out on a surface or to carry the mobility mat 110 when it is in a folded position (see FIG. 7C).

In the illustrated embodiments, the mobility mat 110 additionally includes a cushion 120. The cushion 120 can provide additional padding fix a user when the user exercises on the mobility mat 110. For example, the cushion 120 can be positioned on the top segment 102*a* so that the cushion 120 may be adjacent to the orthopedic device 150. The cushion 120 can provide additional padding as a seat when the user interacts with the orthopedic device 150. In some examples, the cushion 120 can provide padding for a user's shin, a user's forearm, or a user's head and neck during various exercises. In some examples, cushion 120 can be removably attached (using, e.g., hook-and-loop type fasteners or any suitable attaching feature or combination of attaching features) from mobility mat 110. Removably attaching the cushion 120 may be desirable for ease of laundering or replacement. The cushion 120 features are discussed in more detail below with respect to FIGS. 3A-3B.

Referring back to FIG. 1, the mobility mat 110 may also include a receiving element 116. Although receiving element 116 of FIG. 1 is coupled to the bottom segment 102*d*, the receiving element 116 can be located in any of the plurality of segments 102*a*, 102*b*, 102*c*, and 102*d*. The receiving element 116 can be configured to receive a supplemental exercise device such as an exercise band, resistance band, or any other standalone exercise element. Receiving element is discussed further with respect to FIG. 4.

Referring back to FIG. 1, the mobility mat 110 can additionally include a counterbalancing weight (not pictured) in location 125*a* and 125*b*. The counterbalancing weight can serve to provide extra weight to the mobility mat 110 such that ends of the mobility mat 111, and 119 are not pulled up or shifted when a user is performing pushups or sit ups.

Although the figures of the present application show a particular configuration of the assistive features of an exemplary mobility mat, a person skilled in the art would understand that an exemplary mobility mat, according to embodiments of the present disclosure, can have more or less assistive features. For example, although the mobility mat 110 of FIG. 1 includes eight hand holds 108 and two foot holds 106, there can be more or less of either the hand holds 108 or foot holds 106. Additionally, the assistive features can have different arrangements than as shown in the present disclosure, so long as the assistive features are configured to be engaged by a user.

Figure 2A:
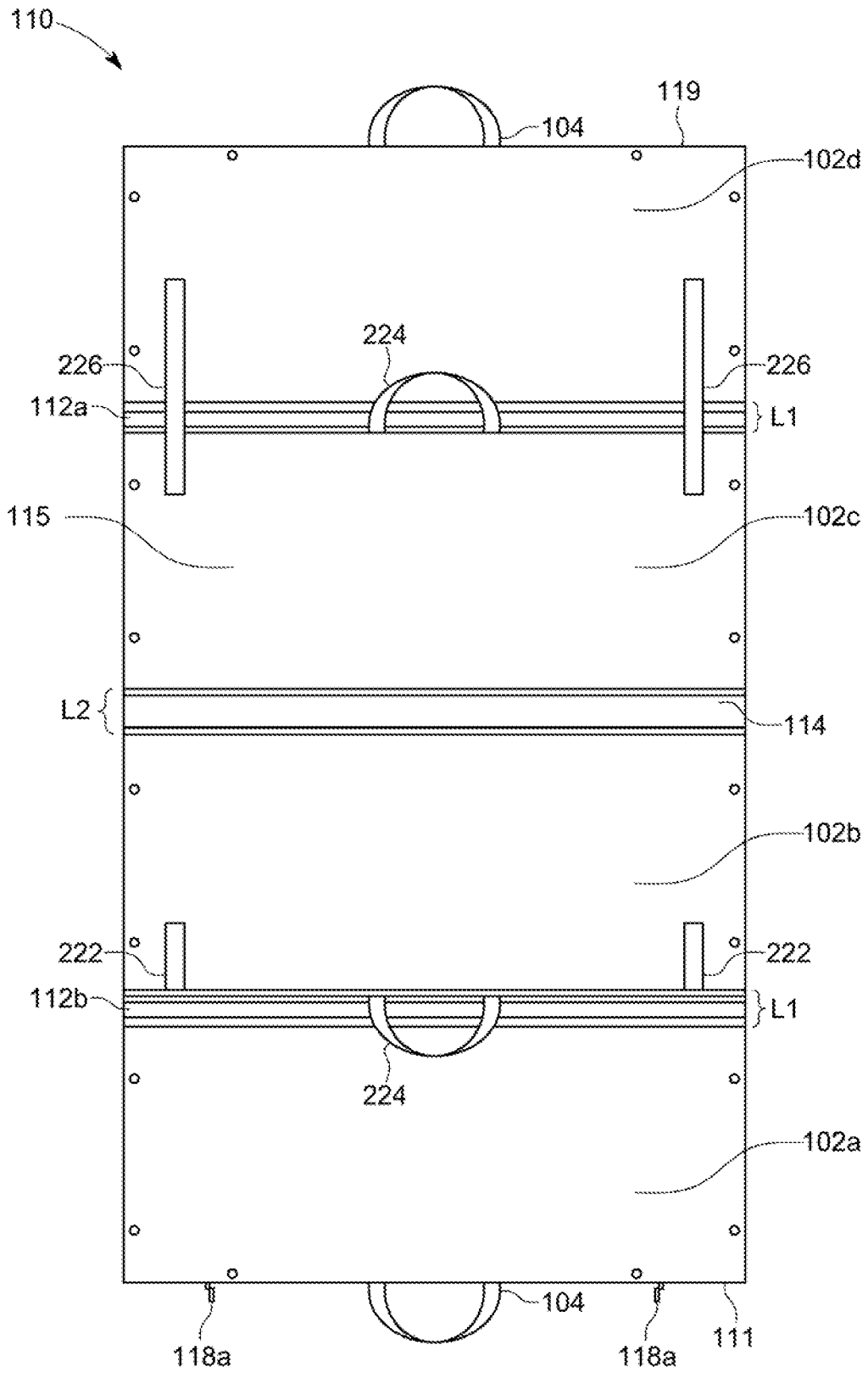
FIG. 2A shows a bottom portion of an exemplary mobility mat according to an embodiment of the present disclosure.

FIG. 2A shows a bottom side 115 of an exemplary mobility mat 110, according to an embodiment of the present disclosure. The mobility mat 110 of FIG. 2A includes similar elements with same numbering and functions as the elements of FIG. 1. Additionally, FIG. 2A shows first coupling elements 222, bottom handles 224, and second coupling elements 226. The first coupling elements 222 and the second coupling elements 226 are configured to mate with one another such that each of the first coupling elements 222 can couple with a respective one of the second coupling elements 226 when in contact therewith. For example, coupling elements 222 and 226 can be hooks, snaps, hook-and-loop type fasteners, Velcro®, male and female connectors, adhesive elements, magnets, or any other material, any combination thereof or the like, or element (or combinations thereof) that generally securely fastens. Coupling elements 222 and 226 can connect with each other when mobility mat is in a folded position in order to assist in securing the mobility mat 110 in folded position (see FIG. 7C). Additionally, the bottom handles 224 as generally positioned can be used to carry mobility mat 110 when mobility mat 110 is in a folded position.

Figure 2B:
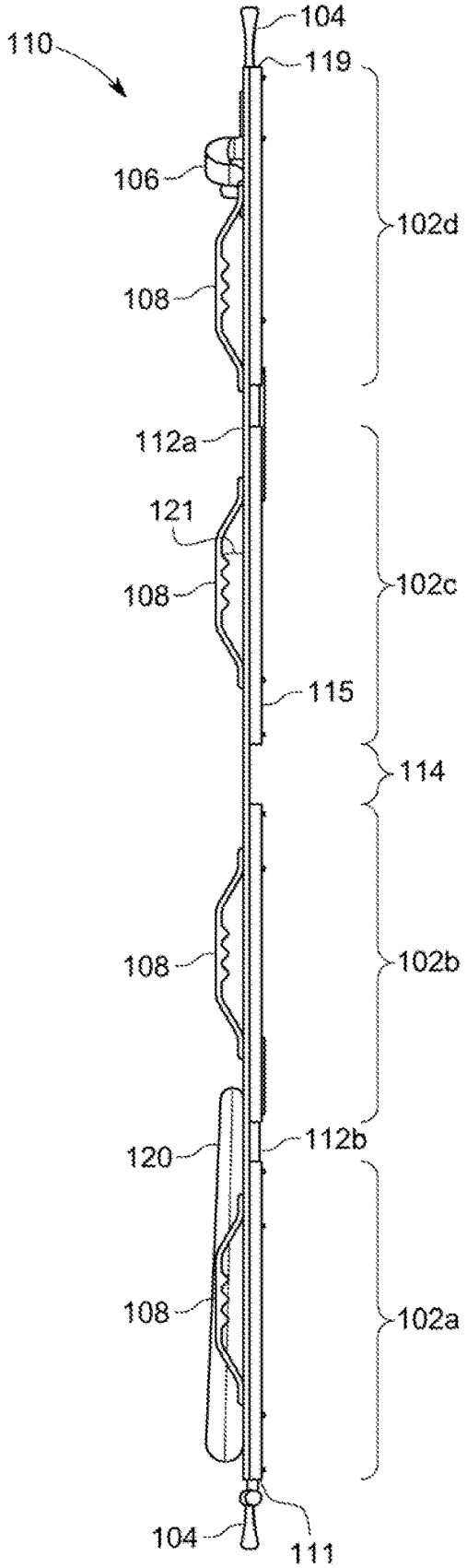
FIG. 2B shows a side view of an exemplary mobility mat according to an embodiment of the present disclosure.

FIG. 2B shows a side view of an exemplary mobility mat 110, according to an embodiment of the present disclosure. FIG. 2B includes similar elements with the same numbering and same functions as elements of FIGS. 1-2A. FIG. 2B shows how specific assistive features extend away from the top surface 113 of the mobility mat 110, thereby forming an aperture 121 between the assistive feature(s) and the top surface 113 of the mobility mat 110. For example, hand holds 108 and foot holds 106 can be configured to extend away from mobility mat 110. The aperture 121 formed therebetween is useful in providing fix easy anchoring of a body limb by a user during an exercise routine.

Figure 3A:
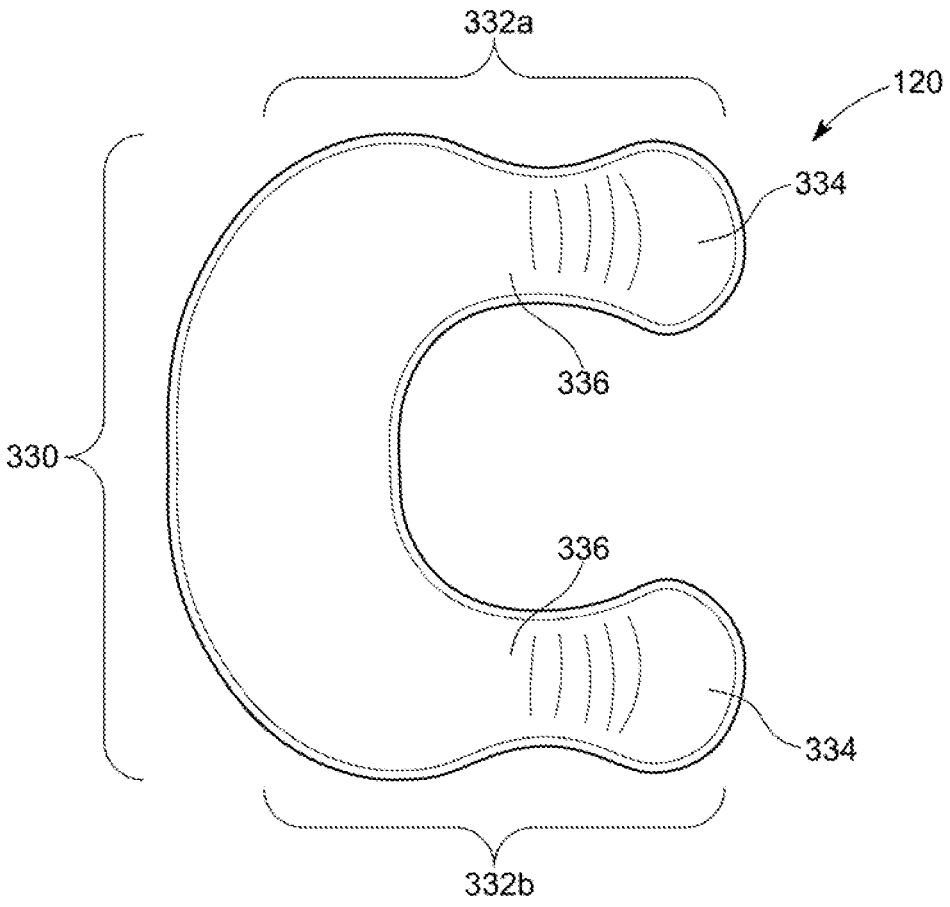
FIG. 3A shows a top view of an exemplary cushion according to an embodiment of the present disclosure.
Figure 3B:
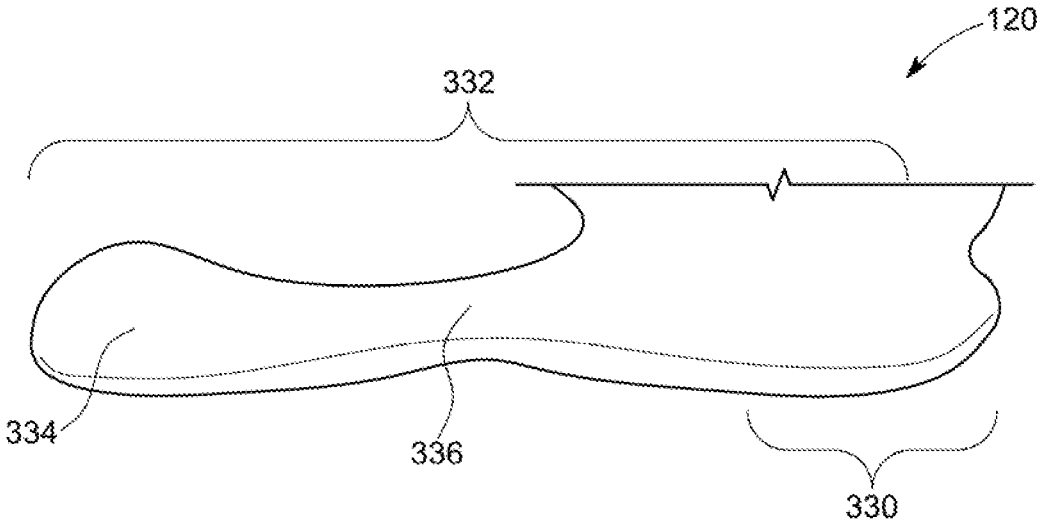
FIG. 3B shows a side view of an exemplary cushion according to an embodiment of the present disclosure.

FIGS. 3A-3B show various perspective views of the exemplary cushion 120, according to one non-limiting embodiment of the present disclosure. The cushion 120 may include a base 330, a first extension 332*a*, a second extension 332*b*, a first portion 334*a*, a second portion 334*b*, and connector portions 336. The cushion 120 can be formed of any suitable material. It may be desirable for the cushion 120 to be formed of a compressible material(s) designed to cushion a user's weight. In one embodiment, the cushion 120 is formed of a foam or foam-like material having a cover thereon (not pictured). The cover can assist in preventing blisters when a user's skin repeatedly contacts the cushion 120 during exercise. Additionally, the cover can assist in wicking away a user's sweat. In some instances, the cover can be removable for ease of laundering, replacement, or interchangeability. As briefly discussed above, the cushion 120 itself can also be removeable from the mobility mat 110.

In one non-limiting embodiment, the cushion 120 is shaped in a hollowed semi-circular shape with a base 330, a first extension 332*a* extending from a first side of the base 330 and a second extension 332*b* extending from the second side of the base. In some embodiments, each extension 332*a* and 332*b* includes an end portion 334*a* and 334*b* and connector portions 336. The end portions 334*a* and 334*b* can be wider than connector portions 336 bridging each respective end portion 334*a* and 334*b* and the base 330. Although an exemplary shape of the cushion 120 is shown in FIGS. 3A-3B, it is contemplated that any shape can be used so long as the cushion is configured to fit within the bottom segment 102*d* of the mobility mat 110. For example, the cushion 120 can be rectangular or circular in nature. The extensions 332*a* and 332*b* likewise can be of any suitable dimensions. For example, the extensions 332*a* and 332*b* can be similar to the length of a forearm of a user, or a length of the top segment 102*a* of the mobility mat 110. Similarly, the base 330 can be configured to extend substantially across the top segment 102*a* such that the first extension 332*a* extends generally parallel with a first edge 123 of the top segment 102*a* and the second extension 332*b* extends generally parallel with a second edge 125 of the top segment 102*a*.

In some examples, the first extension 332*a* and the second extension 332*b* can be in a teardrop shape where the end portions 334*a* and 334*b* are wider than the connector portions 336.

FIG. 3B further demonstrates one embodiment in which the cushion 120 has a contoured design to reduce stress on particular body parts. For example, a main portion of base 330 can have thicker padding than the connector portions 336. End portions of first extension 332*a* and second extension 332*b* can have thicker padding than non-central portions of first and second extension 332*a* and 332*b*.

The cushion 120 can provide padding to a user during exercises. For example, a user can place his forearm along the first extension 332*a* during a side plank. Thicker padding along the base 330 and the teardrop end portion 334*a* assists in allowing the user to reduce stress on his or her write and/or elbow during the exercise. In other examples, the cushion 120 can be used as a seat or as padding while kneeling. In other examples, the area between the extensions 332*a* and 332*b* can be a cutout for a pelvic positioning. Therefore, the shape and padding of the cushion 120 can provide contouring which matches the human form and provides protection of a user's bones, joints, and limbs.

Figure 4:
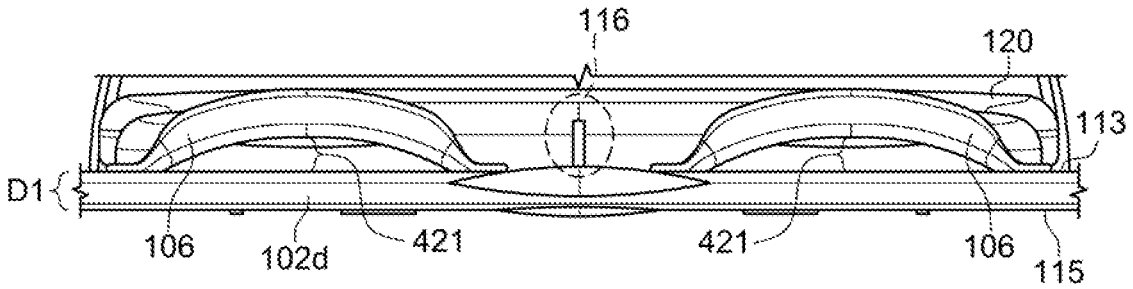
FIG. 4 shows a side view of an exemplary pair of foot holds according to an embodiment of the present disclosure.

FIG. 4 shows a side view of an exemplary pair of foot holds, according to an embodiment of the present disclosure. FIG. 4 shows the foot holds 1 06, the receiving element 116, and the cushion 120. FIG. 4 demonstrates how the foot holds 106 can be configured to extend away from the top surface 113 of the bottom segment 102*d* of the mobility mat 110, at, e.g., a similar height to the padding of the cushion 120. Extending away from the mobility mat 110 at such a height assists in allowing the mobility mat 110 to neatly fold up with the segments being generally flush with one another when the mobility mat 110 is configured in a folded position (see FIG. 7C). Opposing ends of the foot holds 106 may be coupled to and extend from the mobility mat 110 such that the foot holds 106 are curved or in a convex shape, forming an aperture 421 between each of the foot holds 106 and the mobility mat 110. The apertures 421 are generally shaped to receive an insertion of a user's foot. Such aperture 421 may receive a user's foot during exercise routines, for example.

Additionally, foot holds 106 can include a removeable cover (not shown) which provides additional padding. This removeable cover can prevent blistering or skin abrasions of a user's feet while anchoring to the foot holds 106.

FIG. 4 additionally shows a schematic representation of the receiving element 116. The receiving element 116 can be, for example, a j-hook, an s-hook, a clamp hook, a carabineer, or any other receiving element configured to optionally receive or be coupled with additional exercise equipment. For example, the additional exercise equipment can be an elastic exercise device or other resistance tool. In some examples, the receiving element 116 can have an overlay of fabric or padding (not shown) to cover the receiving element 116 when not in use by the user. Such an overlay may assist in preventing injury to the user from unintentional contact with the receiving element 116.

Figure 5:
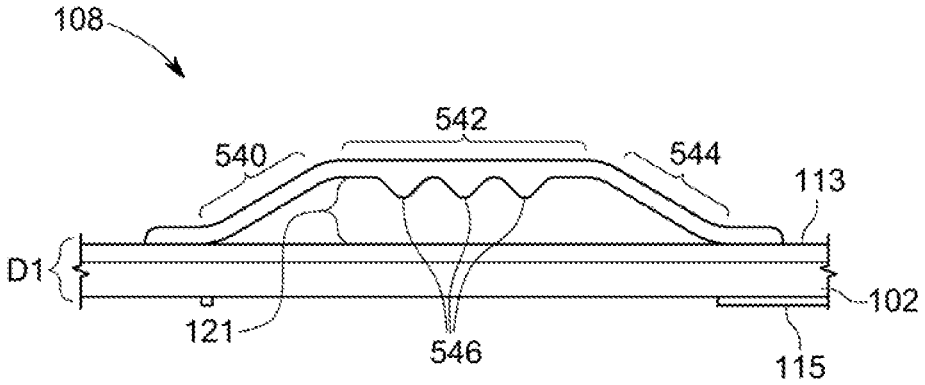
FIG. 5 shows a side view of an exemplary hand hold according to an embodiment of the present invention.

FIG. 5 shows a side view of an exemplary hand hold 108 on any segment 102 of the mobility mat 110, according to an embodiment of the present disclosure. The hand hold 108 can include a first end portion 540, a middle portion 542, a second end portion 544, and optional grips 546, A user can grasp the hand hold 108 during exercise routines while using the mobility mat 110, according to an embodiment of the present disclosure. Each portion 540, 542, and 544 has a unique angle from the user and can therefore exercise different aspects of the user's grip. Additionally, a user can progressively move through grasping each different portion 540, 542, and 544 while exercising. For example, a user can grasp the first end portion 540, then the middle portion 542, and finally the second end position 544 during exercise. The three positions allow a user to gradually advance a hand stretch based on where the user places his or her hand. For example, when grasping first end portion 540, the user's hand can have an initial position where the hand soft tissues begin to relax, stretch, and elongate. When the hand soft tissues are sufficiently relaxed, the user can advance to middle portion 542 to increase the stretch. Finally, the user can advance to second end portion 544 to achieve a maximum stretch. Therefore, a hand hold 108, according to an embodiment of the present disclosure, can provide a progression of position choices.

The grips 546 can be structured to receive a user's fingers. These grips 546 can help the user have a more secure and/or comfortable grip on the hand hold 108.

Figure 6:
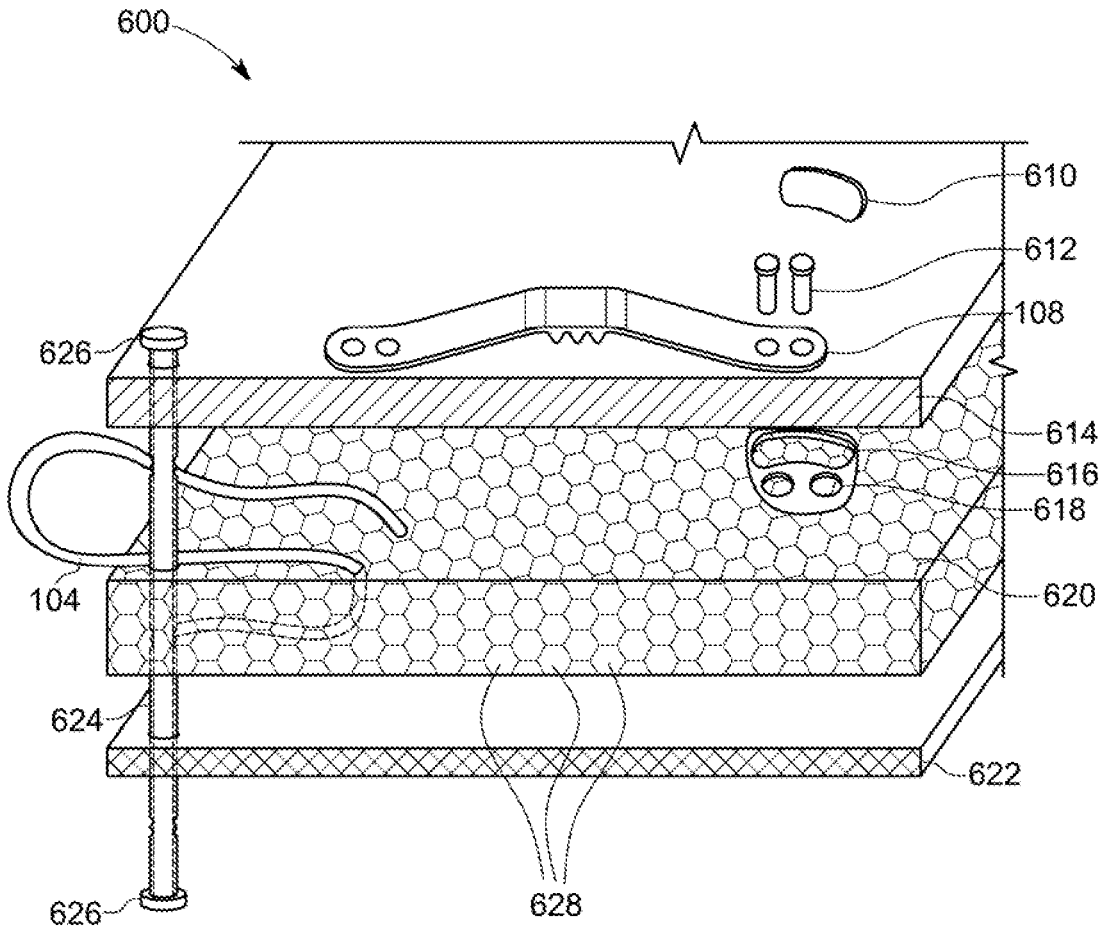
FIG. 6 shows an exploded view of the components of an exemplary mobility mat according to an embodiment of the present disclosure.

FIG. 6 shows an exploded view of a system 600 including components of an exemplary mobility mat, according to an embodiment of the present disclosure. System 600 can include a handle finishing cap 610, one or more screws 612, a hand hold 108, a first layer 61 4, an anchor 616, one or more nuts 618, a second layer 620, a third layer 622, a binding post 624, one or more binding screws 626, and a honeycomb structure 628.

In the illustrated embodiment, the system 600 includes a plurality of layers, such as first layer 614, second layer 620, and third layer 622. Although three layers are shown in FIG. 6, it is contemplated that more or fewer layers can be used so long as the at least one layer is thick enough to provide a desired amount of cushioning for a user. The hand holds 108 (and foot holds 106, not shown in FIG. 6) can be attached to the mobility mat via a handle, the screws 612, an anchor 616 and nuts 618. The screws 612 can attach the hand holds 108 to the first layer 614. A handle finishing cap 610 can be placed on top of the screws 612. The handle finishing cap 610 can protect a user from touching screws 612. The screws 612 can extend through the first layer 614 and receive a corresponding nut 618 and anchor 616. The anchor 616 may assist in anchoring the screws 612 and in reducing stress on first layer 614 resulting from the screws 612. The nuts 618 may also assist in keeping the screws 612 in place. The hand holds 108, foot holds 106, and other supplemental exercise devices, could also be attached to the mobility mat using holding tabs inserted into grommets or apertures formed in the mat body, such as the holding tabs illustrated in FIGS. 16A-16D.

In the embodiment illustrated in FIG. 6, an exemplary first layer 614 can be a rubber yoga mat or any other padding element. The second layer 620 can be a honeycomb rubber mat, for example with a honeycomb structure 628 within the second layer 620. Such a honeycomb structure 628 can assist in reducing the weight of the mobility mat 110 while still providing adequate stability and support. Additionally, the honeycomb structures 628 can receive the handles 104 such that the handles 104 securely attach to and weave through honeycomb structures 628. Weaving through the honeycomb structures 628 allows the handles 104 to securely anchor to the second layer 620. In some embodiments, the second layer 620 can further include adhesive layer on one or both surfaces of to securely couple the first layer 614 to the second layer 620 and the second layer 620 to the third layer 622. The third layer 622 can include a finishing surface such as, for example, corrugated plastic.

In an alternate embodiment of the present invention, the mobility mat (e.g., mat 100') can be constructed from a compliant and pliant foam materials, and moreover can be a single piece construction, such as illustrated in the embodiment shown in FIGS. 10-15.

FIG. 6 also shows binding posts 624 with binding screws 626. Binding posts 624 serve to provide additional stability for the mobility mat 110 in ensuring that the plurality of layers 610, 620, 622 stay attached. Although only one binding post 624 is pictured in FIG. 6, it is contemplated that binding posts 624 can be positioned at, e.g., edges of each segment of the mobility mat to further securely attach the various layers of the mobility mat. For example, a mobility mat can have about twenty binding posts 624 distributed throughout the edges of the layers of an exemplary mobility mat. Binding posts can have binding screws 626 within the binding post 624 to retain a position of the binding post 624.

Although an exemplary, non-limiting layering configuration is shown in FIG. 6, additional layering configurations are contemplated by the present disclosure. For example, foot holds 106 and hand holds 108 can be attached to any layer in the plurality of layers. The second layer 620 is not limited to a honeycomb configuration. In general, the plurality of layers can include a top cushion layer, an internal structural layer, and an inferior layer to anchor foot holds 106 and hand holds 1 08 and provide a protective covering for the internal structural layer. For example, the inferior layer can be made from. a Naugahyde material, a fabric coated with rubber or vinyl resin, or any combinations thereof or similar materials. Such a layering configuration provides structural support and padding for a user and protection and secure attachments for the assistive features.

Figure 7A:
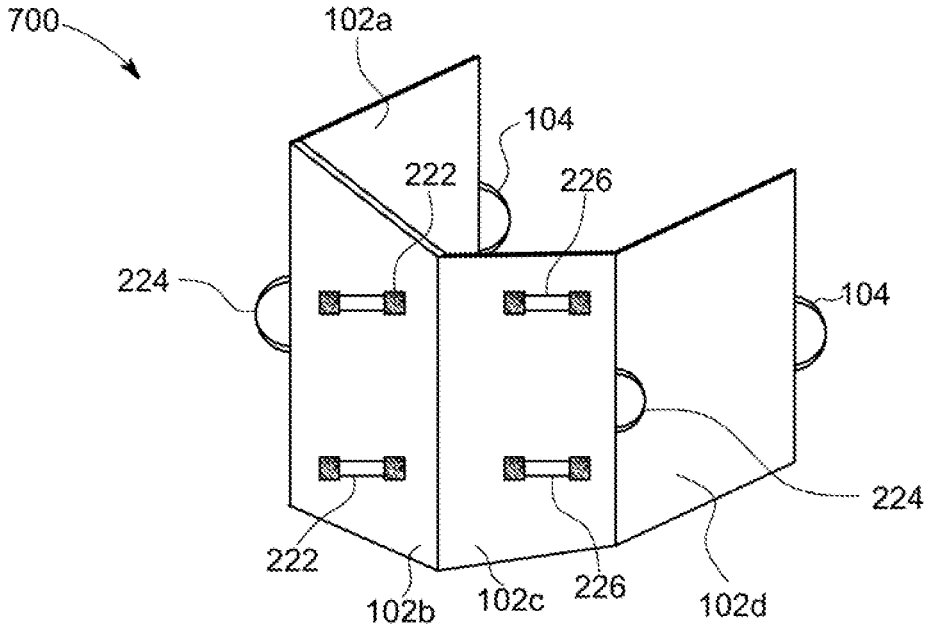
FIG. 7A shows an exemplary mobility mat as the mobility mat begins to fold according to an embodiment of the present disclosure.
Figure 7B:
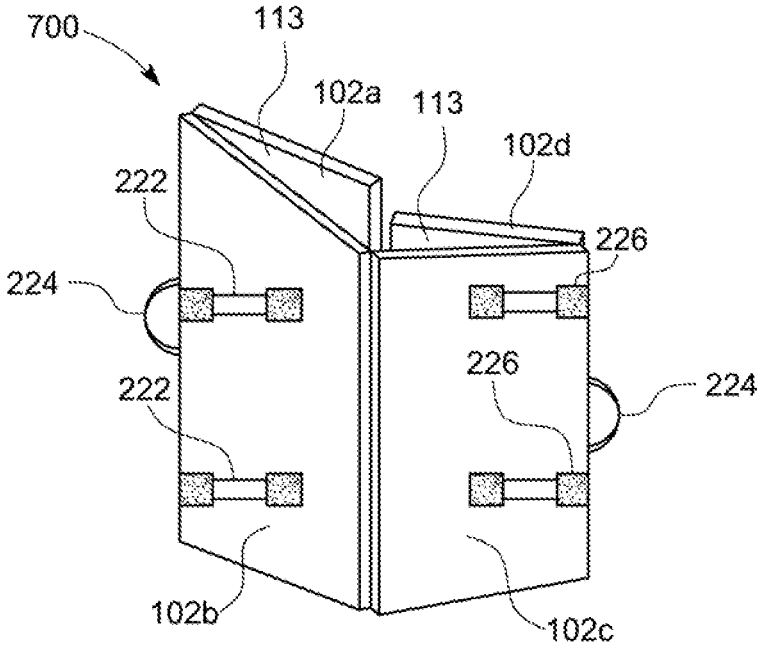
FIG. 7B shows an exemplary mobility mat in an intermediate folding position according to an embodiment of the present disclosure.
Figure 7C:
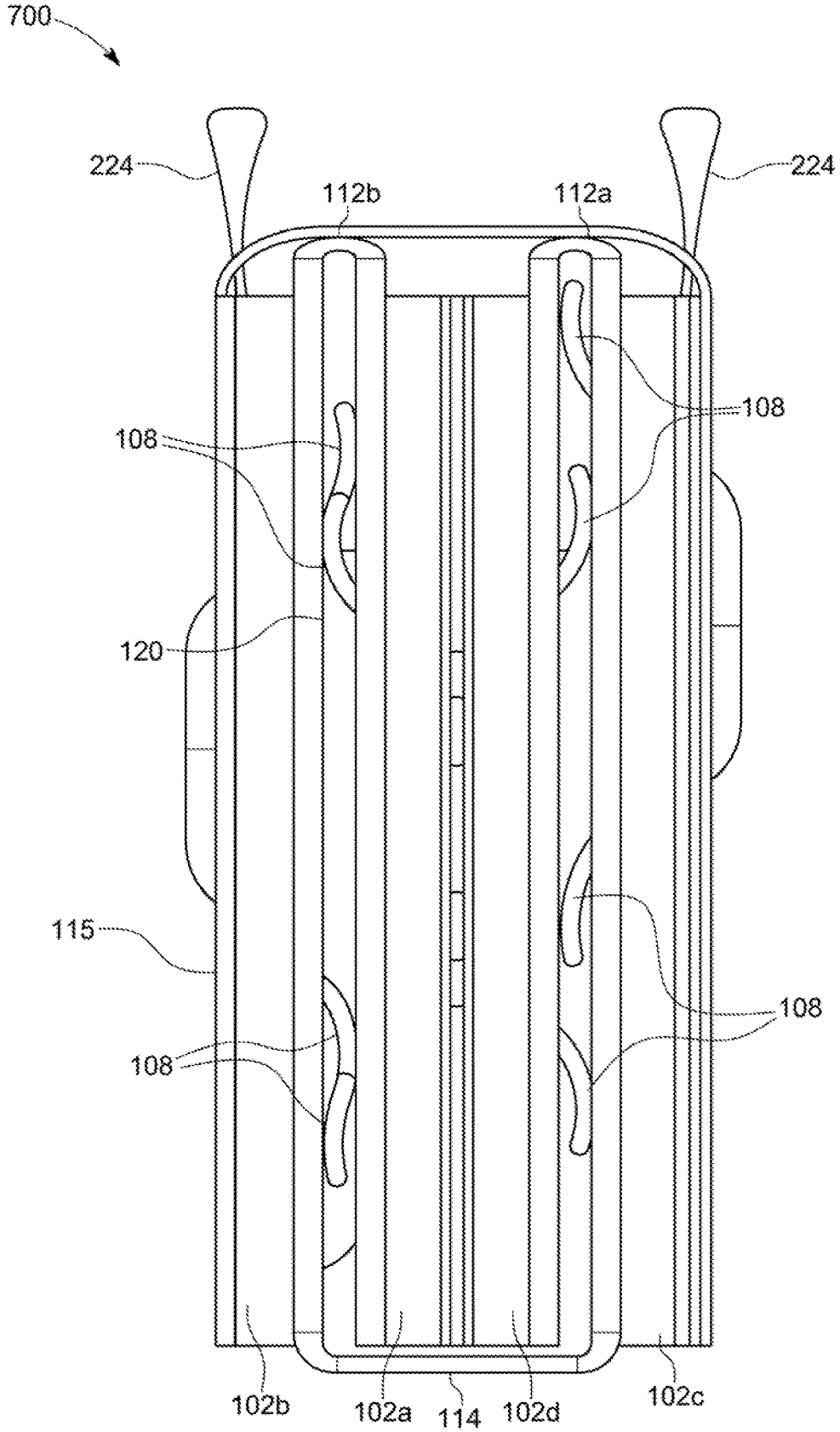
FIG. 7C shows a folded position of an exemplary mobility mat according to an embodiment of the present disclosure.

FIGS. 7A-7C illustrate an exemplary mobility mat being folded into a folded position, according to an embodiment of the present disclosure. FIGS. 7A-7C show an exemplary system 700 with similarly numbered elements and corresponding functions to the elements of FIGS. 1-2B. For example, in FIG. 7A, the top and bottom segments 102*a* and 102*d* can be folded so that top surfaces 113 of segments 102*a* and 102*d* face top surfaces 113 of the second and third segments 102*b* and 102*c*. This folding can happen along respective connecting sections elements 112*a* and 112*b* (see FIG. 1), as described in more detail below. FIG. 7B shows a second folding step can occur along 114 such that bottom surfaces 114 of segments 102*a* and 102*d* face each other.

FIG. 7C illustrates the mobility mat 110 in a generally folded position. FIG. 7C demonstrates how the second and third segments 102*c* and 102*b* have been folded such that bottom surfaces 115 of the top and bottom segments 102*a* and 102*d* face and are generally flush with each other. This folding can be achieved due to the dimensions of the connecting segment 114 (see FIG. 1). Namely, the connecting segment 114 has length L2 generally equal to about twice the depth D1 of a segment 102. FIG. 7C further demonstrates that the assistive features of the mobility mat 110 such as the hand holds 108 and the cushion 120 can be configured to fit neatly against each other while mobility mat 110 is in a folded configuration. Put another way, the assistive features do not interfere with one another, e.g., the tops of the assistive features do not contact one another, thereby reducing the bulk of the mobility mat 110. Additionally, when in the folded position of FIG. 7C, the handles 224 positioned on the bottom surface 115 of the mobility mat 110 are arranged such that a user can carry the mobility mat 110 via the handles 224.

FIGS. 7A-7B further show the first coupling elements 222 and second coupling elements 226. The coupling elements 222 and 226 can be configured to receive one another and secure mobility mat 110 in the folded position. For example, first coupling element 222 can be a female connector and second coupling element 226 can be a male connector. Second coupling element 226 can reach around segments 102*a* and 102*d* to connect with first coupling element 222 when the mobility mat 110 is in the folded position.

Figure 11:
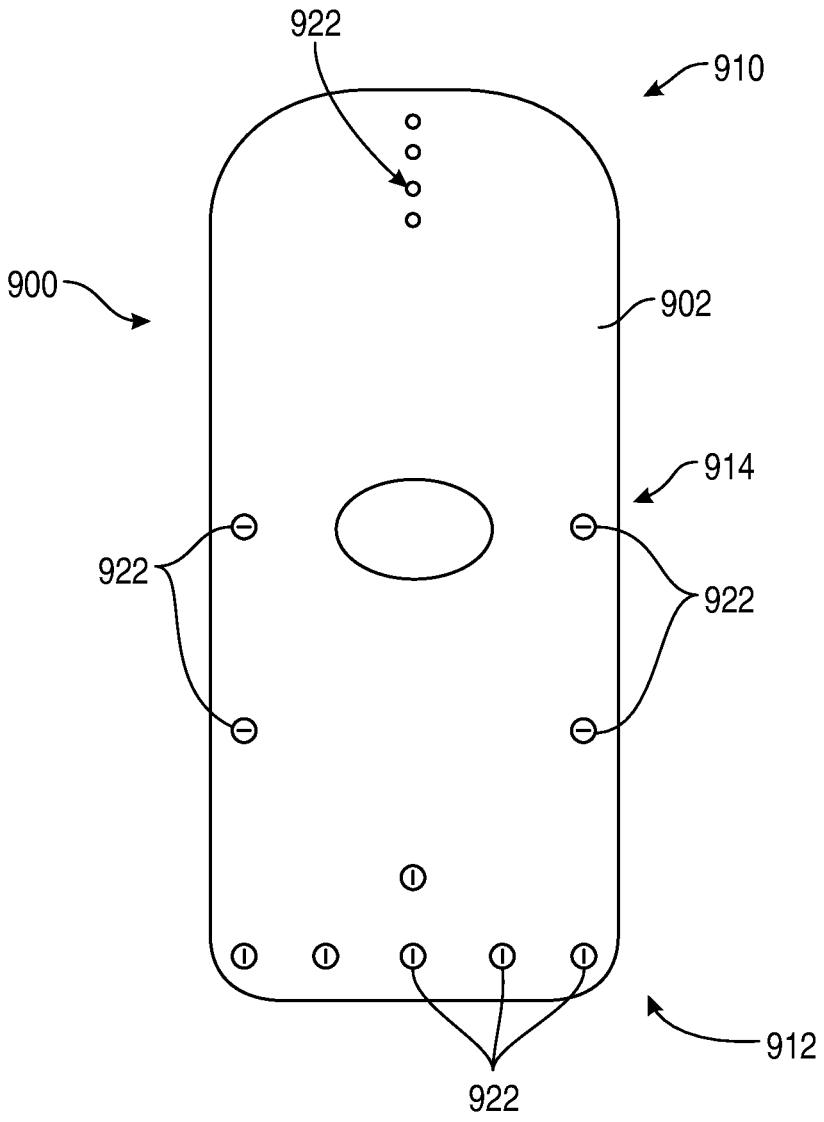
FIG. 11 shows a planar top view of a body portion of the mobility mat of FIG. 10.
Figure 14:
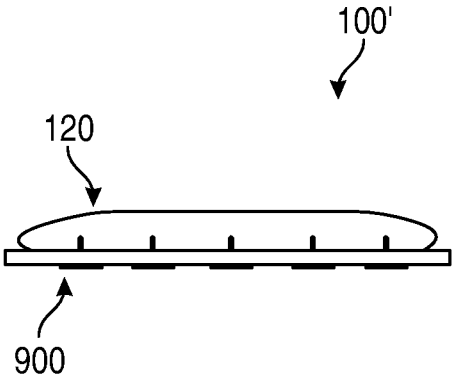
FIG. 14 shows a planar end view of the mobility mat of FIG. 10.
Figure 15:
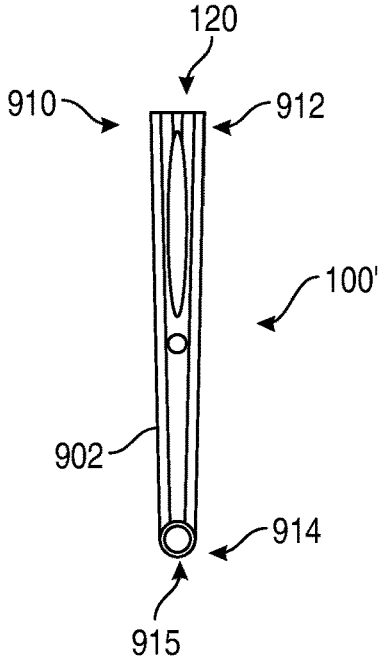
FIG. 15 shows a planar side view of the mobility mat of FIG. 10 in a folded condition.

An alternate embodiment of a mobility mat for use in an exercise system 100' in accordance with the present invention is illustrated in FIGS. 10-15 and generally designated as reference numeral 900. Referring to FIG. 11, the mobility mat 900 generally comprises a single-piece foam body 902 including a top surface and a bottom surface and defining a first end portion 910 and a second end portion 912 with an intermediate portion 914 disposed therebetween. As with other embodiments described herein, the exercise system 100' comprises mobility mat 900, cushion 120, and the orthopedic device 150, as shown in FIGS. 8A-8D. Additionally, as with other embodiments of mobility mats, a variety of supplemental exercise features can be attached to the mobility mat for exercise purposes. The foam body 902 is adapted to be folded about a central axis associated with the intermediate portion 914, or in the alternative rolled up, when not in use. The mobility mat 900 in its folded condition is illustrated in FIG. 15. As so folded, the cushion 120 and supplemental exercise features can be enclosed and held inside the mobility mat 900.

Figure 12:
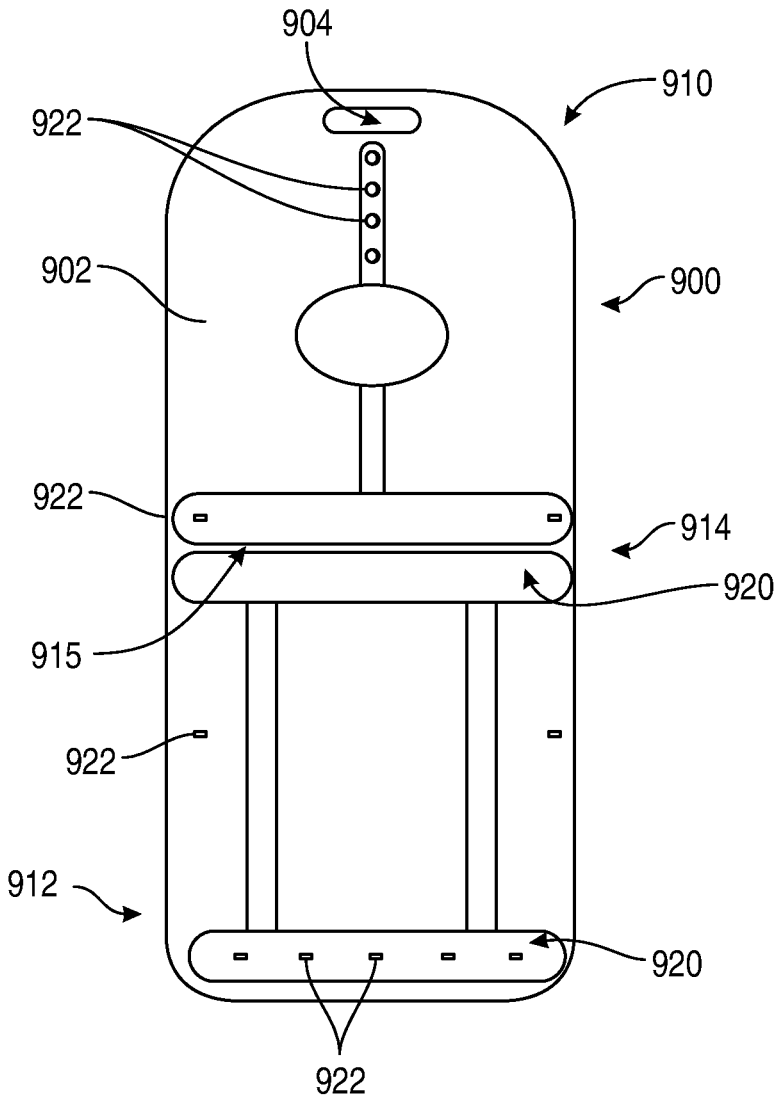
FIG. 12 shows a planar bottom view of the mobility mat of FIG. 10.
Figure 13:
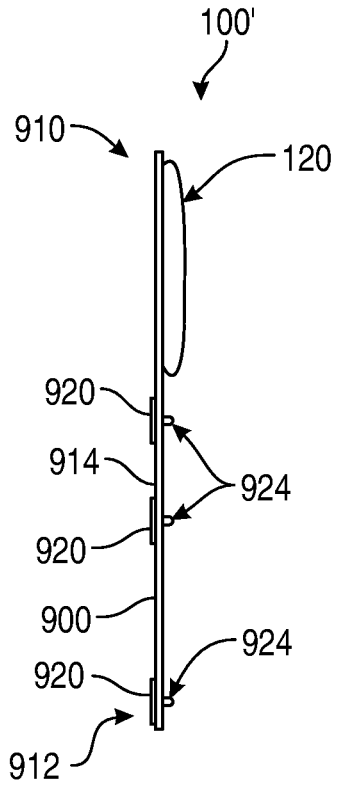
FIG. 13 shows a planar side view of the mobility mat of FIG. 10.

Referring to FIGS. 11-12, the foam body 902 of the mobility mat 900 further comprises a plurality of grommets 922 adapted for securely receiving supplemental exercise features, such as foot holds 906 and hand holds 908, as described herein, as well as a variety of grip devices, such as ball grips 905 and handle grips, and resistance bands 909 and exercise bands. An advantage of the grommets 922, is that the accessories can be positioned in multiple places on the mat body 902 in accordance with the user's desires and needs. For example, the cushion 120 can be attached to the mobility mat 900 at the first end portion 910 thereof. The attachment prevents the cushion 120 from sliding during exercise. As shown in FIG. 11, a series of grommets 922 is provided so that the position of the cushion can be adjusted, perhaps to accommodate the user's size or to conform to a particular exercise or stretching routine.

As shown in FIG. 10, two foot holds 906 are provided on the second end portion 912 of the mobility mat 900. Such foot holds, or in the alternative, hand holds 908, could be positioned in any of multiple locations on the mat 900, including along the edges, such as illustrate din other embodiments shown and described herein. It is noted that the number and positions of grommets 922 shown in FIGS. 10-15 is merely for illustration purposes and can be varied without departing form the principles and spirit of the present invention.

Figure 16A:
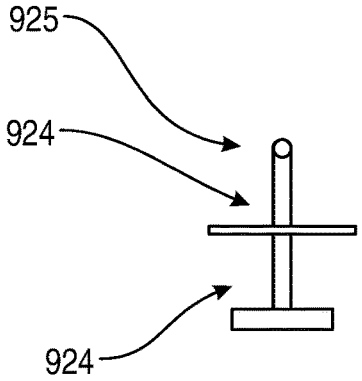
FIGS. 16A-16D illustrate an exemplary holding tab adapted for use with an exercise apparatus in accordance with the present disclosure.
Figure 16B:
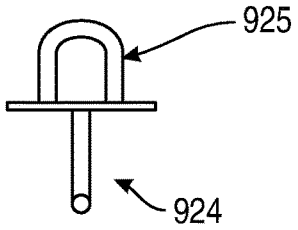
Figure 16C:
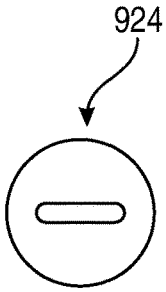
Figure 16D:
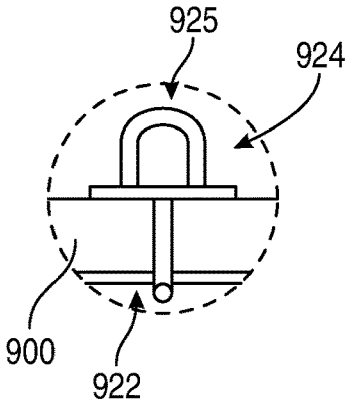

Similarly, as noted, a variety of supplemental exercise features can be securely and removably attached to the mobility mat 900 in locations and positions desirable to the user's needs. Such accessories include additional hand holds 908, resistance bands 909, and various gripping devices, including ball grips 905 and handle grips. In accordance with the present invention, these features are attached using holding tabs 924 that are inserted into the grommets 922 and secured to the mat body 902, as illustrated in FIG. 16D. Notably, referring to FIGS. 16A-16C, the holding tab 924 includes a loop portion 925 that projects outwardly from the top surface of the mat body 902 (as shown in FIG. 14), and flange portion that preferably rests flush with the mat top surface when inserted, and a lower projection that is inserted through the grommet 922. Once the lower projection is inserted, the holding tab 924 is turned 90 degrees to secure the tab in place. Accessory features can then be attached to the mat 900 by clipping a carabiner 926 to the loop portion 925 of the holding tab 924.

Referring to FIG. 12, the bottom side of the mobility mat 900 is illustrated. In order to improve the rigidity and strength of the mat 900, as well as to further secure the holding tabs 924, reinforcing structures can be attached to the foam body 902 of the mobility mat 900. As illustrated, these reinforcing structures comprise metal strips, for example, aluminum plates, generally designated as reference numerals 920. Such plates 920 are positioned so as not to interfere with use of the mobility mat 900 or folding or rolling up of the mat 900 when no longer in use.

Folding of the mobility mat 900 can be facilitated by providing a hinge 915 along a midway central axis associated with the intermediate portion 914 of the mobility mat 900. Folding or carrying of the mat 900 can also be aided by a handle 904 provide in the first end portion 910 of the mat 900. Though not shown, a similar handle can be provided on the second end portion 912 instead or as well.

In accordance with embodiments of the present invention, the mobility mat 900 can be combined with an orthopedic device 150 as described herein.

Figure 8A:
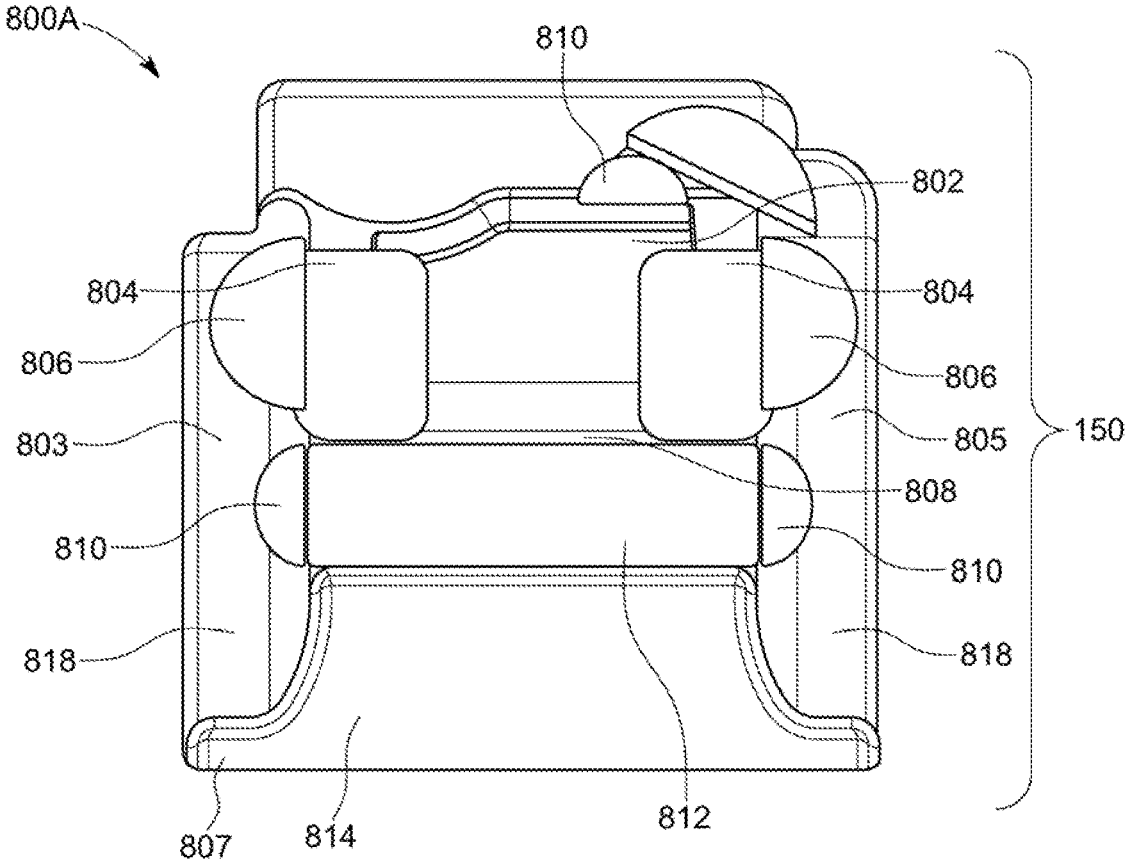
FIG. 8A shows a top perspective view of an exemplary orthopedic device according to an embodiment of the present disclosure.
Figure 8B:
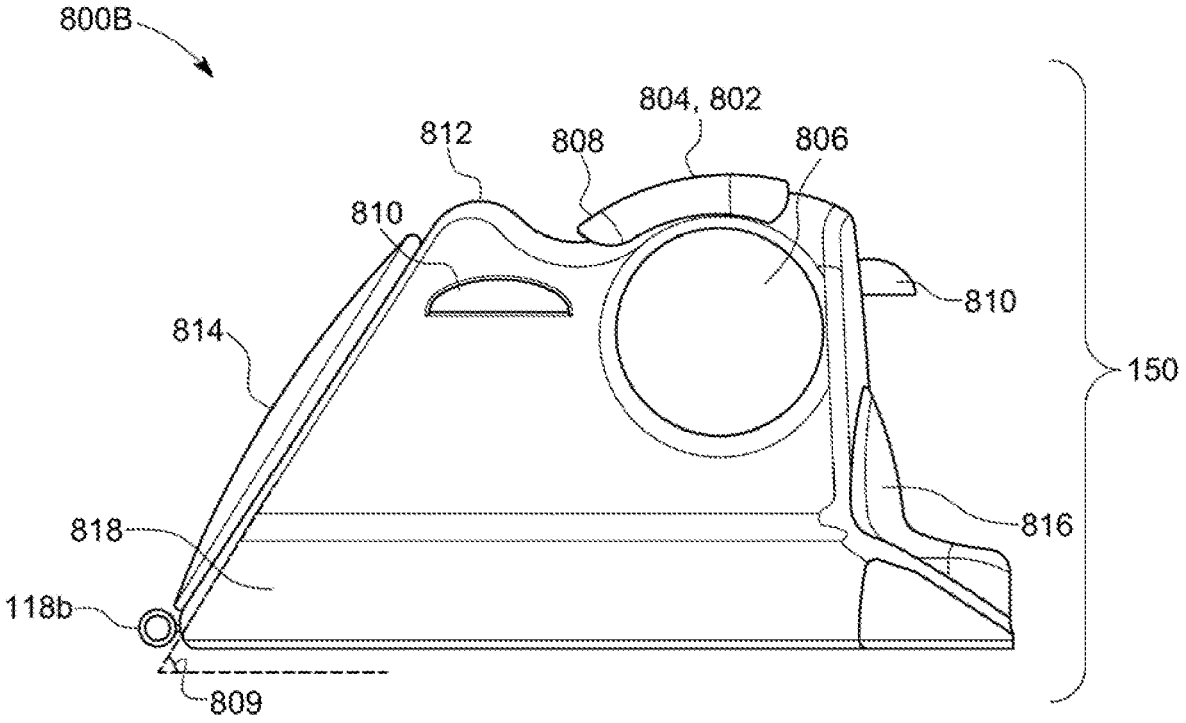
FIG. 8B shows a side perspective view of an exemplary orthopedic device according to an embodiment of the present disclosure.
Figure 8C:
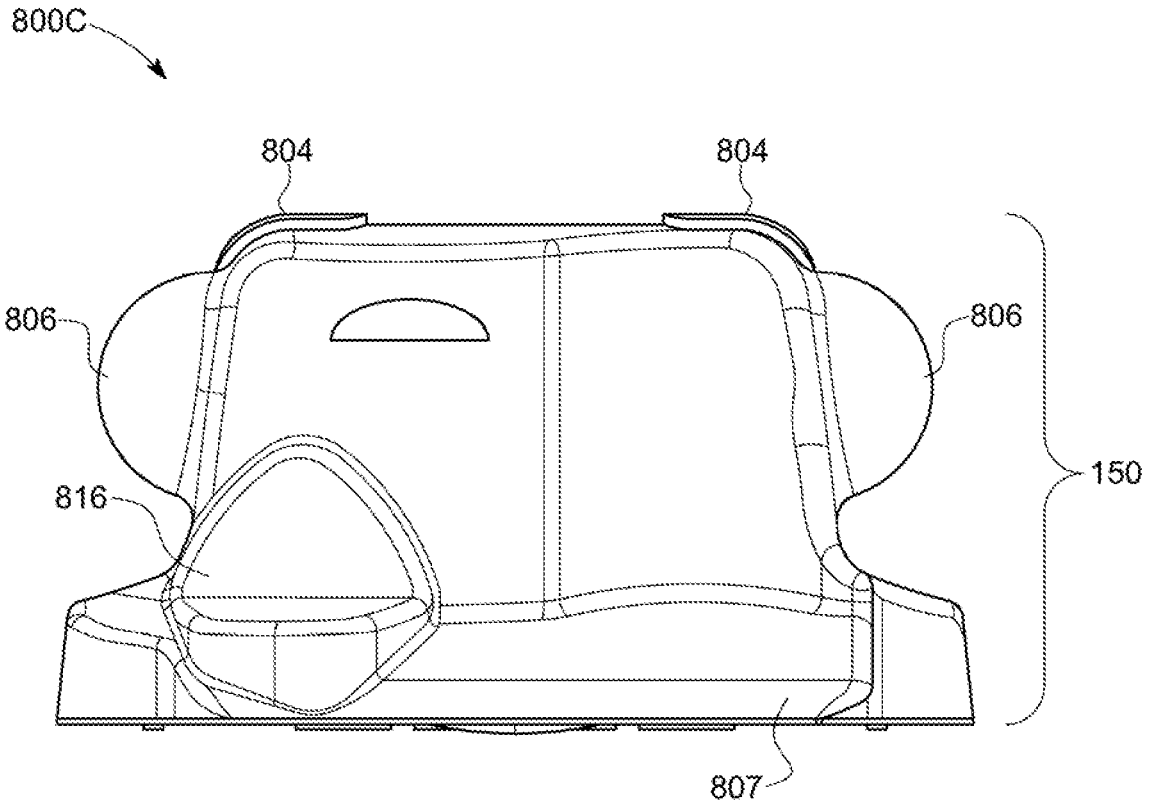
FIG. 8C shows a rear perspective view of an exemplary orthopedic device according to an embodiment of the present disclosure.
Figure 8D:
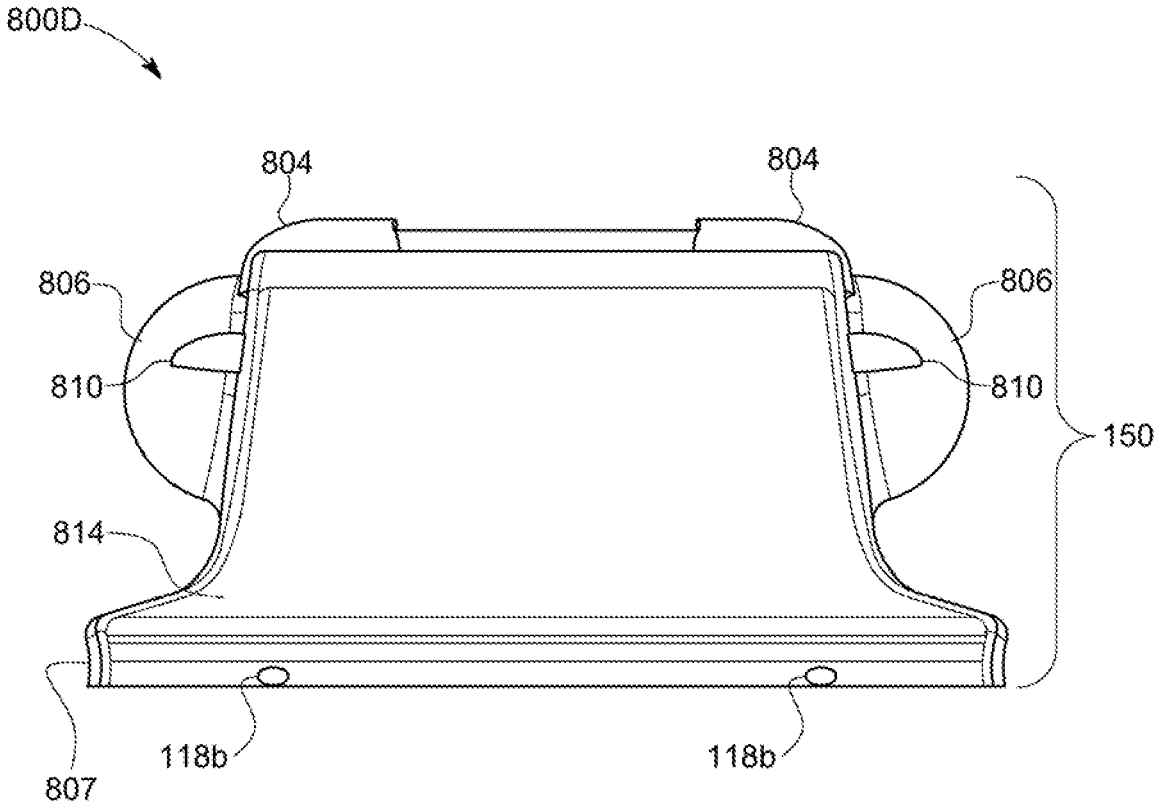
FIG. 8D shows a front perspective view of an exemplary orthopedic device according to an embodiment of the present disclosure.

FIGS. 8A-8D show various perspective views of an exemplary orthopedic device 150, according to an embodiment of the present disclosure. FIG. 8A shows a view of a contoured side 800A, FIG. 8B shows a view of a side with support handles 800B, FIG. 8C is a rear-facing view of a side with a two-tiered ledge 800C and FIG. 8D shows a front-facing view of an inclined side 800D. The orthopedic device 150 of FIGS. 8A-8D includes a first generally curved portion 802, padding elements 804, generally rounded hand holds 806, a valley portion 808, one or more generally flat hand grips 810, a second generally curved portion 812, an inclined portion 814, a two-tier triangular ledge 816, and one or more ledges 818.

Although not shown, orthopedic device 150 can further include a removable cover made of some type of fabric, leather, a synthetic material, any combinations thereof or any other material. The cover can reduce any chance of blisters or skin abrasions of the user while using the device.

The contoured side 800A, as shown in FIG. 8A, generally includes the first generally curved portion 802 and the second generally curved portion 812. The first generally curved portion 802 and the second generally curved portion 812 are generally parallel to one another and are separated from one another by a valley portion 808. The contoured side 800A can have hand grips 806 and padding elements 804 on either side of first generally curved portion 802. A user can lean on the padded elements 804 of the first generally curved portion 802 when performing exercises. The padding and the generally rounded nature of the region can reduce stress on a user's wrist joint as the user performs assisted pushups, planks, or other exercises. Padded elements 804 can comprise some type of fabric, leather, a synthetic material, any combinations thereof, or any other material.

The user can also lean on the generally rounded hand grips 806 for further joint relief and engage in contouring joint exercises. FIG. 8A also shows the two generally opposing sides 803, 805 further discussed in FIG. 8B.

Referring now to FIG. 8B, the side face 800B shows how the second generally curved portion 812 can have a similar radius of curvature to the valley portion 808. For example, the radius of curvature can be similar to a radius of a user's forearm or a user's calf. Therefore, the valley portion 808 can readily receive a user's shin or forearm performing various exercises. Additionally, the first curved portion 802 can have a radius of curvature substantially larger than a radius of curvature of either second curved portion 812 or valley portion 808. The different curvatures can allow a user to interact with the first and second rounded portions 802, 812 in a variety of grips.

FIG. 8B also shows exemplary placement locations for the generally rounded hand grips 806 and generally flat hand grips 810. The generally rounded hand grips 806 and generally flat hand grips 810 can be placed at the top of the side 800B such that a user may achieve notable elevation when grasping and leaning on the grips 806 and 810. The generally rounded hand holds 806 can provide for roundly contouring joints, while the generally flat hand grips 810 can provide for precision rolls of a user's hands. The rounded support of hand holds 806 allows relaxed wrist positioning such that a user has freedom of movement of the shoulder and arm. Therefore, the generally rounded hand holds 806 allow soft joint positioning for continuous chains of comfortable joint movement.

The generally flat hand grips 810 can provide upper and lower body mobility as the holds 806 may assist in positioning a user's wrist in a different orientation than if the user used a flat surface such as the ground or floor. A user may position his or her hand on the generally flat hand grips 810 in progressive chains of movement. Additionally, or alternatively, the generally flat hand grips 810 can be used as a foot ledge fora user's foot during stretching and other movements requiring additional support.

The two-tiered ledge side 800C, as shown in FIG. 8C, may include a two-tiered triangular ledge 816. The two-tiered triangular ledge can be large enough to receive a user's foot and can be positioned several inches above the ground. For example, a user can rest his or her foot and body weight on the two-tiered triangular ledge 816 while his or her leg is over the orthopedic device 150. The two-tiered triangular ledge 816 can provide toe extension stretches, a full plantar stretch, and full hand mobility.

FIG. 8C further shows exemplary proportions of generally rounded hand grips 806 and generally flat hand grips 810 in proportion to one another and in proportion to the orthopedic device 150. For example, flat hand grips 810 can be smaller in size to only receive the heel of a user's hand. Rounded hand grips 806 can be larger such that an entire hand can grasp the grip and rely on the grip with body weight. For example, finger strength can be more engaged in the rounded hand grips 806 than in the flat hand grips 810. Generally, there are no set sizes for grips 806 and 810, however both should desirably be sized to receive or accommodate a user's hand. Rounded hand grips 806 can be dome-shaped.

The inclined side 800D, as shown in FIG. 8D, can include an inclined portion 814 that may flare outwards at or near the base 807 of the orthopedic device 150. The inclined portion 814 can slope at an angle 809 of about 50 degrees, or any other angle between 0 degrees and 90 degrees. A slight slope around 50 degrees can assist in supporting a user while the user does, e.g., sit-ups. For example, a user would only have to perform the remaining 40 degrees sit-up movement, instead of having to raise his or her torso all 90 degrees from a position of laying flat on the mobility mat to a position of sitting straight upwards.

In some instances, the orthopedic device 150 can be housed and/or stored within a cover (not shown). The cover can be removable, washable, and/or provide sweat absorbent or sweat wicking features.

Example Exercise Positions

Figure 9A:
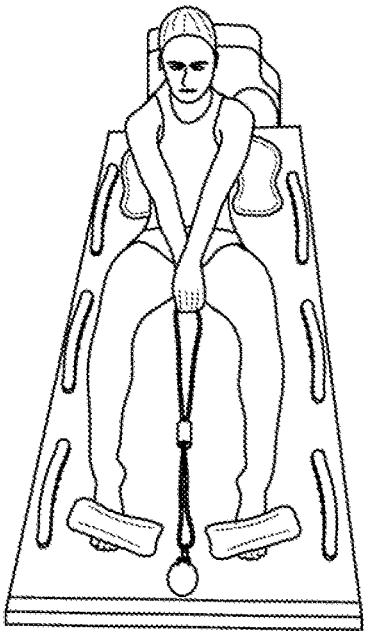
FIG. 9A shows an exemplary exercise position with a resistance band enabled by an exemplary exercise apparatus according to an embodiment of the present disclosure.

FIGS. 9A-9D show examples of exercise positions enabled by an exemplary exercise apparatus, according to an embodiment of the present disclosure. FIG. 9A shows an exemplary position where a user seated on the mobility mat 110 described herein can anchor his or her feet via the foot holds 106 while using an exercise band attached to the receiving element 116. In other exercises of similar positions, a user could perform sit-ups, abdominal workouts, and/or stretches when sitting on the mobility mat 110 and anchoring his or her feet in foot holds 106.

Figure 9B:
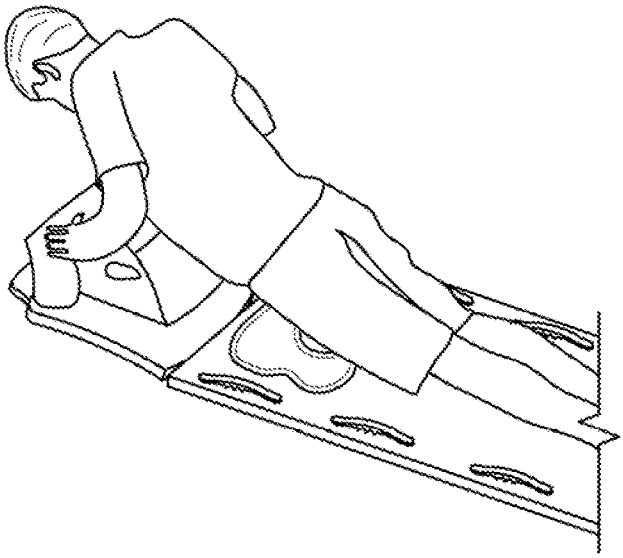
FIG. 9B shows an exemplary pushup position enabled by an exemplary exercise apparatus according to an embodiment of the present disclosure.

FIG. 9B shows a user performing triceps pushups assisted by the orthopedic device 150 described herein. The orthopedic device 150 can reduce the gravitational force on a user's triceps due to the elevation of the apparatus. Therefore, orthopedic device 150 can assist a user with exercises that a user would be unable to perform without orthopedic device 150. The orthopedic device 150 may also assist a user with positioning his or her hands, thereby assisting to achieve the maximum effectiveness from the exercise.

Figure 9C:
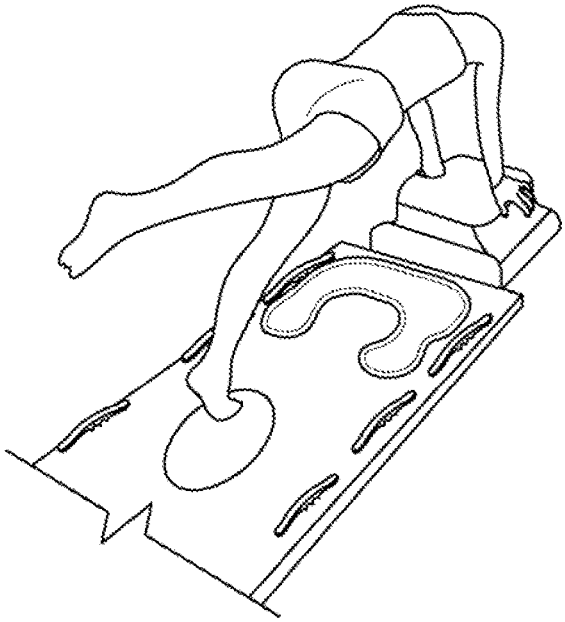
FIG. 9C shows an exemplary plank position enabled by an exemplary exercise apparatus according to an embodiment of the present disclosure.

FIG. 9C shows a user performing stretching and conditioning exercises while grasping the padded portions 804 of first curved portion 802 of the orthopedic device 150. Such a position assists in reducing stress on a user's metacarpals and wrists while performing the exercises. Therefore, an exercise apparatus as provided fix by the present disclosure, can assist in allowing a user to more effectively isolate and exercise a particular limb or muscle group while minimizing the risk of pain from another body area.

Figure 9D:
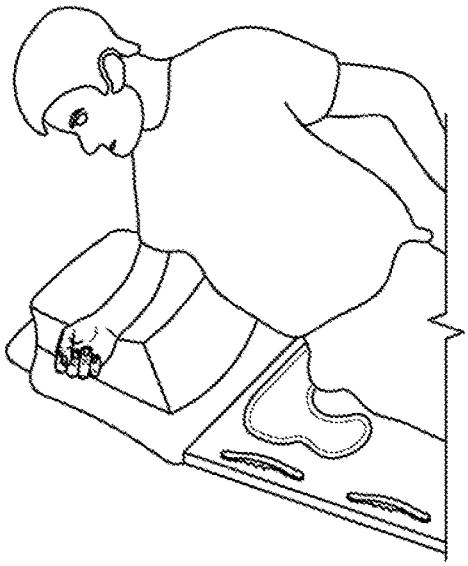
FIG. 9D shows an exemplary side plank position enabled by an exemplary exercise apparatus according to an embodiment of the present disclosure.

FIG. 9D shows a user performing a side plank while placing his forearm into the valley portion 808 of the orthopedic device 150. The elevation of the orthopedic device 150 and curved nature of the valley portion 808 provides a comfortable mechanism for a user to lean on while performing exercises. Therefore, a user can more effectively concentrate and exercise his or her targeted area.

Embodiments of the present disclosure provide assistive features that can enable proper joint movement, strengthening and conditioning exercises, functional training, balance work, rehabilitative work across different stages of recovery, progressive positions, and many other exercise and rehabilitative functions as any person skilled in the art would understand. The present disclosure provides a device that allows users to exercise joint movement that they could not exercise without such assistive features. The progressive positioning, in particular, allow a user to exercise end-of-range joint movement and advance the periphery of the user's movement.

Therefore, the present disclosure provides an all-in-one exercise apparatus that can be used in a variety of different exercise positions fix a variety of different joints movements and conditioning. The number of assistive features and the flexibility of each assistive feature to be used in many different orientations provides an exercise apparatus unparalleled in the conventional exercise market. Moreover, the present disclosure provides an exercise apparatus that assists users in performing exercises that they could not do on their own, without an assistive feature. For example, some users could not do a pushup without a foot anchor or could not perform certain stretches without a hand hold.

While various examples of the present invention have been described above, it should be understood that they have been presented by way of example only, and not limitation. Numerous changes to the disclosed examples can be made in accordance with the disclosure herein without departing from the spirit or scope of the invention. Thus, the breadth and scope of the present invention should not be limited by any of the above-described examples. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application, The terminology used herein is for the purpose of describing particular examples only and is not intended to be limiting of the invention. As used herein, the singular forms "a," "an," and "the" are intended to include the plural forms as well, unless the context dearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. Furthermore, terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A mobility mat, comprising:

a foam body including a top surface and a bottom surface and defining a first end portion and a second end portion with an intermediate portion disposed therebetween, said foam body being a one-piece mat adapted to be rolled up without being folded; and a cushion coupled to the foam body, wherein the cushion is shaped in a hollowed semi-circular configuration to yield a base, a first extension generally extending from a first side of the base, and a second extension generally extending from a second side of the base, wherein the foam body further comprises a plurality of grommets adapted for receiving at least one supplemental exercise tool.

2. The mobility mat according to claim 1, wherein the foam body further includes at least one of a foot hold or a hand hold, wherein said at least one foot hold or hand hold can be coupled to the top surface of said foam body in one of the first end portion and the second end portion.

3. The mobility mat according to claim 2, wherein the at least one of a foot hold or a hand hold comprises a foot hold coupled to the top surface of the foam body in the second end portion.

4. The mobility mat according to claim 1, wherein the cushion is contoured such that central regions of the base and end regions of the first extension and the second extension are higher than non-central regions of the base.

5. The mobility mat according to claim 1, wherein the supplemental exercise tool comprises at least one of a foot hold, a hand hold, a resistance band, a ball grip, or a handle grip.

6. The mobility mat according to claim 1, wherein the foam body is a single-piece construction and comprised of a single layer.

7. The mobility mat according to claim 1, wherein the foam body is comprised of a plurality of layers, wherein at least one layer in the plurality of layers is comprised of a material with a honeycomb structure.

8. The mobility mat according to claim 1, further comprising at least one reinforcing structure coupled to the bottom surface of said foam body.

9. The mobility mat according to claim 8, wherein the at least one reinforcing structure comprises an aluminum strip coupled to the foam body.

10. The mobility mat according to claim 9, wherein the aluminum strip can be aligned with at least one of the plurality of grommets to respectively reinforce attachment of the at least one supplemental exercise tool to the foam body.

11. The mobility mat according to claim 1, further comprising holding tabs respectively adapted for attachment to the plurality of grommets.

12. The mobility mat according to claim 11, wherein each holding tab comprises a projection adapted to be inserted through a corresponding grommet and secured thereto and a loop adapted to receive a corresponding supplemental exercise tool, wherein when the holding tab is secured to the foam body, the loop projects upwardly from the top surface of the foam body.

13. The mobility mat according to claim 1, further comprising an orthopedic device capable of being coupled to the first end portion of the foam body, said orthopedic device comprising:

a first side, comprising an inclined portion;

a second side, comprising a two-tiered ledge;

opposing side portions bridging the first side and the second side, each of the opposing side portions including a generally rounded hand grip and a generally flat hand grip; and a contoured top side, wherein the contoured top side further comprises a first generally curved portion, a valley portion, and a second generally curved portion, the first and second generally curved portions being generally parallel to one another, and the first and second generally curved portions being separated by the valley portion.

14. The orthopedic device according to claim 13, wherein the second generally curved portion and the valley portion have substantially similar radii of curvature.

15. The orthopedic device according to claim 14, wherein a radius of curvature of the first generally curved portion is substantially larger than the radius of curvature of either the second generally curved portion or the valley portion.

16. The orthopedic device according to claim 15, wherein the generally rounded hand grip is generally domed-shaped.

17. An exercise system comprising:

a mobility mat comprising:

a foam body including a top surface and a bottom surface and defining a first end portion and a second end portion with an intermediate portion disposed therebetween, said foam body being a one-piece mat adapted to be rolled up without being folded, wherein the foam body further comprises a plurality of grommets adapted for receiving at least one supplemental exercise tool;

a cushion coupled to the foam body, wherein the cushion is shaped in a hollowed semi-circular configuration to yield a base, a first extension generally extending from a first side of the base, and a second extension generally extending from a second side of the base; and at least one first connector positioned at the first end portion of the foam body, wherein the at least one supplemental exercise tool comprises at least one of a foot hold, a hand hold, a resistance band, a ball grip, or a handle grip adapted for attachment to the foam body using at least one of the plurality of grommets; and an orthopedic device comprising a plurality of sides and at least one second connector, the plurality of sides further comprising:

a first side, comprising an inclined portion;

a second side comprising a two-tiered ledge;

opposing side portions bridging the first side and the second side, each of the opposing side portions including a generally rounded hand grip and a generally flat hand grip; and a contoured top side;

wherein the at least one second connector of the orthopedic device is configured to receive the at least one first connector of the mobility mat such that the orthopedic device may be removably coupled to the mobility mat.

18. The exercise system according to claim 1, wherein the mobility mat further comprises at least one reinforcing structure coupled to the bottom surface of said foam body, wherein said at least one reinforcing structure does not inhibit the rolling up of the mobility mat.

* * * * *